US008561982B2

(12) United States Patent
Ogasawara

(10) Patent No.: US 8,561,982 B2
(45) Date of Patent: Oct. 22, 2013

(54) SHEET CONVEYING APPARATUS, AUTOMATIC DOCUMENT FEEDING APPARATUS INCLUDING SAME, IMAGE FORMING APPARATUS WITH FIRST SHEET CONVEYANCE GUIDE HAVING AN OPENING

(75) Inventor: Hironori Ogasawara, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 408 days.

(21) Appl. No.: 12/852,546

(22) Filed: Aug. 9, 2010

(65) Prior Publication Data

US 2011/0052289 A1 Mar. 3, 2011

(30) Foreign Application Priority Data

Aug. 28, 2009 (JP) ..... 2009-198454

(51) Int. Cl.
*B65H 29/58* (2006.01)

(52) U.S. Cl.
CPC ..... *B65H 29/58* (2013.01)
USPC ..... 271/186; 271/287

(58) Field of Classification Search
USPC ..... 271/186, 287
See application file for complete search history.

(56) References Cited

U.S. PATENT DOCUMENTS 5,358,239 A 10/1994 Hario et al.
5,915,692 A * 6/1999 Lu et al. ..... 271/279

FOREIGN PATENT DOCUMENTS

| | | | |
|---|---|---|---|
| JP | 62-191361 A | | 8/1987 |
| JP | 62191361 A | * | 8/1987 |
| JP | 03-249058 A | | 11/1991 |
| JP | 05-147800 A | | 6/1993 |
| JP | 06-115789 A | | 4/1994 |
| JP | 06-127781 A | | 5/1994 |
| JP | 10-212063 A | | 8/1998 |
| JP | 10-268683 A | | 10/1998 |
| JP | 11-127301 A | | 5/1999 |
| JP | 2007-243787 A | | 9/2007 |

* cited by examiner

*Primary Examiner* — Gerald McClain
(74) *Attorney, Agent, or Firm* — Renner, Otto, Boisselle & Sklar, LLP

(57) ABSTRACT

A sheet carrying apparatus, being applicable in (i) an automatic document feeding apparatus and/or (ii) paper feeding and conveying mechanism of an image forming apparatus, has an opening in that part of a curved guiding surface of a lower conveyance guide of a sheet conveyance guiding section constituting a curved conveyance path, which receives a front end of a document fed to the curved conveyance path. The opening has such a size in a guide width direction orthogonal to a document conveying direction, which is passable for a small size sheet not larger than a predetermined size. With this, the small size sheet passed through the opening is sorted out.

5 Claims, 13 Drawing Sheets

ENLARGED VIEW OF A SECTION

SHEET CONVEYING APPARATUS, AUTOMATIC DOCUMENT FEEDING APPARATUS INCLUDING SAME, IMAGE FORMING APPARATUS WITH FIRST SHEET CONVEYANCE GUIDE HAVING AN OPENING

This Nonprovisional application claims priority under 35 U.S.C. §119(a) on Patent Application No. 2009-198454 filed in Japan on Aug. 28, 2009, the entire contents of which are hereby incorporated by reference.

TECHNICAL FIELD

The present invention relates to (i) a sheet conveying apparatus in an image forming apparatus such as a copying machine, a multifunctional peripheral, a facsimile apparatus, or the like, (ii) an automatic document feeding apparatus, and (iii) an image forming apparatus.

BACKGROUND ART

An image forming apparatus (for example, which is a digital copying machine) includes a sheet conveying apparatus (es). As a sheet conveying apparatus provided for transporting a document, an automatic document feeding apparatus (ADF) is provided in the image forming apparatus. The automatic document feeding apparatus (ADF) (i) receives a document from a placement tray, (ii) transports the document to a reading (scanning) section, and (iii), after an image on the document is read out, delivers the document to a delivery tray. On the other hand, as a sheet conveying apparatus provided for transporting a printing sheet, a paper feeding conveying mechanism is provided in the image forming apparatus. The paper feeding conveying mechanism (i) receives a sheet from a paper feeding cassette, (ii) transports the sheet to an image forming section, and (iii), after an image is formed on the sheet by the image forming section, delivers the sheet to a delivery tray.

According to the sheet conveying apparatus of the above type, a pickup roller picks up one sheet at a time from the placement tray storing a stack of sheets such as documents, paper, or the like. Thereafter, the sheet is transported by a plurality of conveyance roller pairs provided to a sheet conveyance path, and then delivered to a delivery tray. The sheet conveyance path includes a conveyance guide for guiding the sheet. The plurality of conveyance roller pairs are provided along the conveyance guide.

Patent Literatures 1 through 3 disclose automatic document feeding apparatuses each including two delivery trays. In each of such automatic document feeding apparatuses, a paper transporting path (hereinafter referred to as a path) being extended downstream of a reading section branches into (i) a straight conveyance path and (ii) a U-turned conveyance path, (i) the straight conveyance path being extended straight in a conveying direction of a document being passed through the reading section, and (ii) the U-turned conveyance path having a U-turn shape so that a conveying direction of a document passed through the reading section is u-turned upwardly and backwardly. Therefore, a destination to which a document is delivered can be switched between the two delivery trays.

The document being transported via the straight conveyance path is delivered to the delivery tray which is outwardly extended from a lateral side of the automatic document feeding apparatus. On the other hand, the document being transported via the U-turned conveyance path is delivered to the delivery tray which is provided above a document placement tray.

Conventionally, switching of the destination between the delivery trays is carried out by a configuration which includes, at a branch between the straight conveyance path and the U-turned conveyance path, a conveyance-path switching section including a gate (branch nail), a solenoid, and the like. A control section causes a gate position to be switched from one to another, so that the document is sent to either the straight conveyance path or the U-turned conveyance path, and then delivered to corresponding one of the deliver tray provided at downstream in the conveying direction or the delivery tray provided above the document placement tray.

Patent Literature 1 teaches an art in which such switching is carried out according to a thickness of a document. This is because in a case where a document (such as a catalog or the like) not thinner than a certain thickness is fed into a U-turned conveyance path, the document may have a curling tendency, and/or jamming by the document is caused. In view of this, Patent Literature 1 delivers a thin document, i.e., a normal document, via the U-turned conveyance path, and a thick document via a straight conveyance path.

Patent Literature 4 discloses an automatic document feeding apparatus, which solely includes (i) a U-turned conveyance path and (ii), as a delivery tray, a delivery tray provided above a document placement tray. The delivery tray provided above the document placement tray has a merit that causes no increase in an installation space, as compared to a case with a delivery tray extended outwardly to a lateral side.

Furthermore, recent wide spread use of an image filing technique contributes to a development of an automatic document feeding apparatus which allows for image reading (scanning) of a document smaller than a normal document of any size from A5 to A3, such as a business card, a member ID card, or the like. There has been an increasing demand that a paper feeding conveying mechanism for transporting a printing sheet carries out (i) transporting a recording sheet smaller than a normal recording sheet of any size from A5 to A3, i.e., a recording sheet having a size of a business card, a member ID card, or the like, and (ii) delivering the recording sheet after an image formation is carried out onto it.

CITATION LIST

Patent Literature 1
Japanese Patent Application Publication, Tokukaihei, No. 11-127301 A
Patent Literature 2
Laid-Open Utility Model Application, Jitsukaisho, No. 59-46062 A
Patent Literature 3
Japanese Patent Application Publication, Tokukaihei, No. 6-115789 A
Patent Literature 4
Japanese Patent Application Publication, Tokukai, No. 2007-243787 A

SUMMARY OF INVENTION

Technical Problem

A document such as a business card, a member ID card, or the like is thicker than a normal document, and more difficult to curl. Thus, if such document is delivered via a U-turned conveyance path after being passed through a reading section, it is more likely that jamming is caused in an automatic document feeding apparatus.

The configuration of Patent Literature 1 may be an option to deal with this. With the configuration, the document such as a business card or a member ID card is transported via the straight conveyance path to the delivery tray provided on the lateral side of the automatic document feeding apparatus, depending on a thickness detected.

Such configuration employs a conveyance-path switching section for switching, from one to another, paths for passing therethrough a document (i.e., switching delivery trays from one to another). However, the configuration requires to include members for constituting the conveyance-path switching section, such as a gate, a solenoid, or the like, and a sensor for determining a thickness of the document. Thus, a number of components is increased, and this consequently leads to an increase in cost. Further, it is necessary for the configuration to include a control section for carrying out control of the gate. This leads to a further increase in cost. Also, since the configuration employs the conveyance-path switching section, the conveyance path is increased in size, thereby casing an entire apparatus to be increased in size. Therefore, the configuration cannot meet a need for downsizing.

Now consider an image forming apparatus configured to carry out image formation onto a recording sheet, having a size of a business card, a member ID card, or the like and smaller than a normal recording sheet of A5 to A3 size, and delivery of the recording sheet thereby having an image thereon. Such image forming apparatus may employ any of the configurations in Patent Literatures 1 through 3, so as to satisfy the demand that the recording sheet smaller than the normal recording sheet be delivered to a different delivery tray than a delivery tray for receiving a delivery of the normal recording sheet. With the image forming apparatus therefore including (i) a conveyance path switching section at a branch of conveyance paths and (ii) a control section for carrying out control of path switching, it is possible to easily delivery the recording sheet smaller than the normal recording sheet to the different delivery tray.

However, as in the case of the automatic document feeding apparatus which employs the configuration in Patent Literature 1, the image forming apparatus above includes the conveyance path switching section, and the control section for controlling the conveyance path switching section. Thus, there is a problem in that (i) a cost is increased, and (ii) a whole apparatus has an increased size.

Solution to Problem

The present invention is made in view of the problem, and an object of the present invention is to provide a sheet conveying apparatus, use of which in an automatic document feeding apparatus and/or a paper conveying apparatus of an image forming apparatus does not require any increase in cost or any increase in apparatus size in order to bring about an effect that a recording sheet smaller than a normal recording sheet, i.e., a recording sheet of a size of a business card, a member ID card, or the like, be easily fed to a different conveyance path so as to be delivered to a different delivery tray.

In order to attain the object, a sheet conveying apparatus of the present invention is a sheet conveying apparatus, including: a curved conveyance path on which a sheet is transported along a curve of the curved conveyance path; and a first sheet conveyance guide having a curved guiding surface and defining the curved conveyance path, that part of the curved guiding surface of the first sheet conveyance guide, which receives a front end of the sheet fed to the curved conveyance path in a sheet feeding direction, having an opening, the opening having such a size in a guide width direction orthogonal to the sheet feeding direction that allows passage of a small size document not larger than a predetermined size and blocks passage of a large size document larger than the predetermined size.

With the configuration, it is caused that (i) the small size sheet out of sheets being fed into the curved conveyance path, the small size sheet being not larger than the predetermined size, is transported via the opening to an outer side of the curved conveyance path, and (ii) the large size sheet out of the sheets being fed into the curved conveyance path, the large size sheet being larger than the predetermined size, is transported to an inner side of the curved conveyance path. This eliminates the need for a configuration which includes (i) a switching section at a branch of the conveyance paths, the switching section including members such as a gate, a solenoid for driving the gate, and the like, and (ii) a control section for carrying out control of the switching section, based on a sheet size. It is therefore possible that with a simple configuration, sheet sorting and transporting be carried out.

In order to attain the object, an automatic document conveying apparatus of the present invention is an automatic document feeding apparatus including a sheet conveying apparatus of the present invention for transporting a document which is a sheet.

In order to attain the object, an image forming apparatus of the present invention is an image forming apparatus, including: an image forming section for carrying out image printing onto a paper; and a sheet conveying apparatus of the present invention for transporting, from the image forming section to a paper delivering section, the paper which is a sheet.

In the sheet conveying apparatus of the present invention, as described above, it is possible that with a simple configuration, sheet sorting and transporting is carried out, based on a size of the sheet. Thus, for example, applying of the sheet conveying apparatus of the present invention into an automatic document feeding apparatus and/or a paper feeding conveying mechanism of an image forming apparatus does not require either any increase in cost or any increase in an apparatus size, in order to bring about an effect that a document and/or a recording sheet smaller than a normal recording sheet (i.e., a document and/or a recording sheet of a business card size, a member ID card size, or the like) can be easily fed into a different conveyance path so as to be delivered into a different delivery tray.

Advantageous Effects of Invention

As described earlier, a sheet conveying apparatus of the present invention is a sheet conveying apparatus, including: a curved conveyance path on which a sheet is transported along a curve of the curved conveyance path; and a first sheet conveyance guide having a curved guiding surface and defining the curved conveyance path, that part of the curved guiding surface of the first sheet conveyance guide, which receives a front end of the sheet fed to the curved conveyance path in a sheet feeding direction, having an opening, the opening having such a size in a guide width direction orthogonal to the sheet feeding direction that allows passage of a small size document not larger than a predetermined size and blocks passage of a large size document larger than the predetermined size.

The configuration includes, at a branch of the conveyance path, no switching sections that includes the members such as a gate, a solenoid for driving the gate, and the like. With such simple configuration, however, it is possible that sheet sorting and transporting be carried out, based on a size of the sheet.

DESCRIPTION OF EMBODIMENTS

First Embodiment

One embodiment of the present invention is described below with reference to the drawings.

(Description of how Image Forming Apparatus Operates)

Figure 2:
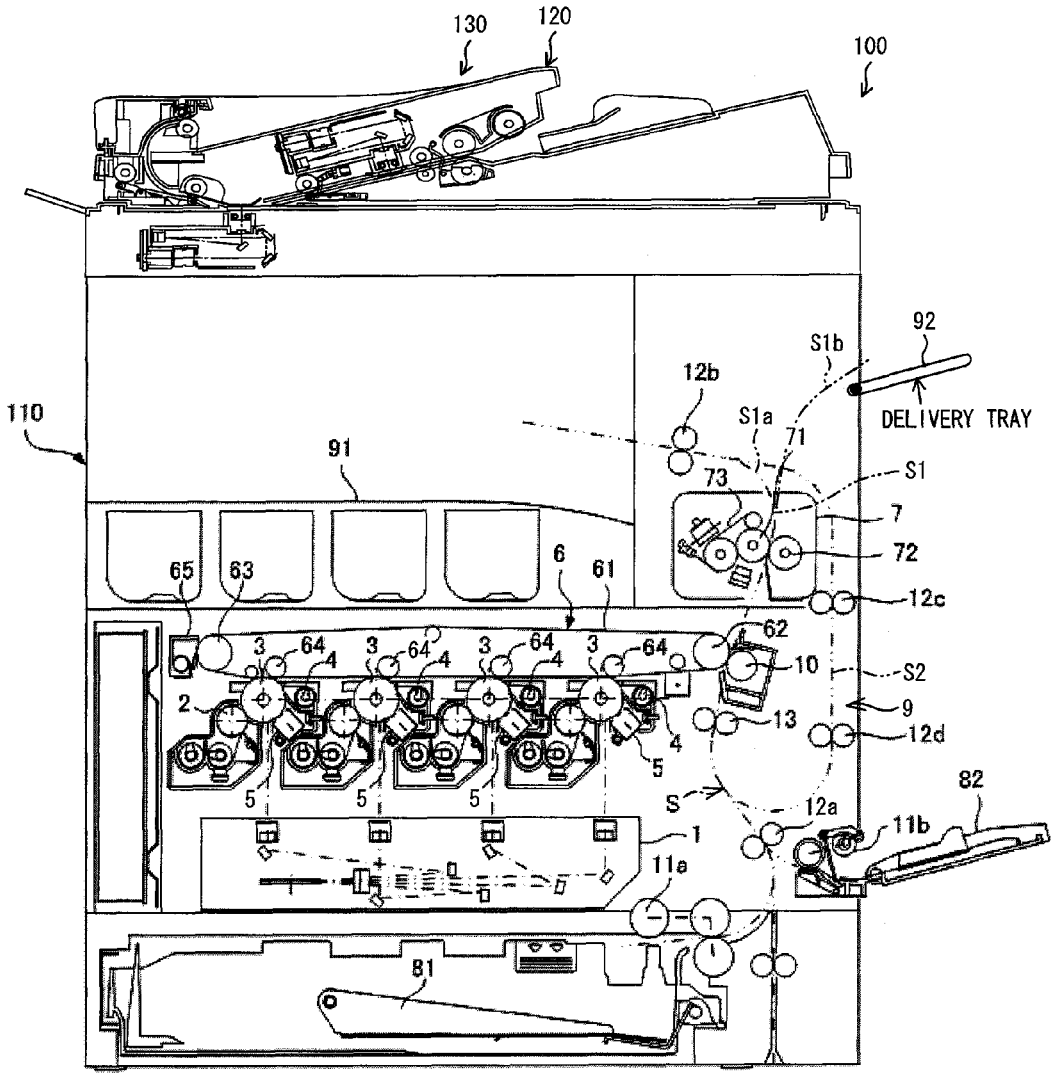
FIG. 2 is an explanation view showing a configuration of the image forming apparatus including the sheet conveying apparatus, in accordance with the one embodiment of the present invention.

FIG. 2 is an explanatory view showing a configuration of an image forming apparatus 100 in accordance with a present embodiment. The image forming apparatus 100 of the present embodiment causes formation of a multi-color image and/or a one-color image on a predetermined recording sheet (sheet), based on image data externally obtained or image data read out (scanned) in the image forming apparatus 100.

As shown in FIG. 2, the image forming apparatus 100 includes (i) an apparatus main unit 110 for carrying out image formation according to image data, and (ii) a document reading apparatus 130 for reading out (scanning) an image on a document. The document reading apparatus 130 is provided above the apparatus main unit 110. A sheet conveying apparatus of the present invention is employed in each of (i) an automatic document feeding apparatus 120 of the image reading apparatus 130 and (ii) a paper feeding conveying mechanism 9 of the apparatus main unit 110. A detail regarding this is later described.

The apparatus main unit 110 includes an exposure unit 1, developing machines 2, photoreceptor drums 3, cleaner units 4, charging devices 5, an intermediate transfer belt unit 6, a transfer roller 10, a fixing unit 7, a paper feeding cassette 81, a manual paper feeding tray 82, an in-body delivery tray 91, the paper feeing conveying mechanism 9, and the like.

Image data to be processed in the image forming apparatus 100 of the present invention are image data corresponding to a color image composite of colors of black (K), cyan (C), magenta (M), and yellow (Y). In view of this, there are provided four image stations allocated for the respective colors. With this, four latent images corresponding to the respective colors can be formed. Each of the four image stations includes a developing machine 2, a photoreceptor drum 3, a charging device 5, and a cleaner unit 4.

The charging device 5 acts as charging means for uniformly charging a surface of the photoreceptor drum 3 by a predetermined electric potential. The charging device 5 may be of a charger type as shown in FIG. 2, of a contact roller type, or of a brush type.

The exposure unit 1 is configured as a laser-scanning unit (LSU) including a laser emission section, a reflection mirror, and the like. The exposure unit 1 includes a polygon mirror for causing laser beam scanning, and an optical element such as a lens and/or a mirror for directing a laser beam reflected by the polygon mirror to the photoreceptor drum 3. A detail configuration of an optical scanning unit constituting the exposure unit 1 is later described. The exposure unit 1 can have other configurations than the above. For example, the exposure unit 1 can employ an EL or an LED writing head in which light-emitting devices are arranged in array.

The exposure unit 1 exposes a charged surface of the photoreceptor drum 3 to light, based on image data externally received or image data read out by the document reading apparatus 130. Thus, the exposure unit 1 has a function to form an electrostatic latent image on the surface of the photoreceptor drum 3 according to the image data. The developing machine 2 develops with one of four color (YMCK) toners the electrostatic image formed on the photoreceptor drum 3. The cleaner unit 4 removes and collects a residual toner which remains on the surface of the photoreceptor drum 3 after the development and image transfer.

The intermediate transfer belt unit 6, which is provided above the photoreceptor drum 3, includes an intermediate transfer belt 61, an intermediate transfer belt driving roller 62, an intermediate transfer belt driven roller 63, four intermediate transfer rollers 64, and an intermediate transfer belt cleaning unit 65. The four intermediate transfer rollers 64 are allocated for the respective colors of YMCK.

The intermediate transfer belt 61 runs around the intermediate transfer belt driving roller 62, the intermediate transfer belt driven roller 63, and the four intermediate transfer rollers 64. The four intermediate transfer rollers 64 each provide a transfer bias, with which the toner image on the photoreceptor drum 3 is transferred onto the intermediate transfer belt 61.

The intermediate transfer belt 61 and photoreceptor drums 3 make contact with each other. Toner images of the respective colors on the photoreceptor drums 3 are transferred to the intermediate transfer belt 61 one after another, such that the toner images transferred to the intermediate transfer belt 61 are on top of one another. In view, the intermediate transfer belt 61 has a function to form thereon a color toner image (multi-color toner image). The intermediate transfer belt 61 is made from, for example, a film having a thickness in an approximate range from 100 μm to 150 μm, and is formed in an endless form.

The intermediate transfer rollers 64 cause the toner image transfer from the photoreceptor drums 3 to the intermediate transfer belt 61. Each of the intermediate transfer rollers 64 makes contact with a back surface of the intermediate transfer belt 61. Each of the intermediate transfer rollers 64 receives the transfer bias of a high voltage (which is of an opposite polarity (+) to a charge polarity (−) of the toners), so as to cause the toner images transfer. Each of the intermediate transfer rollers 64 is a roller whose base is a metal (e.g., stainless steel) shaft having a diameter in a range from 8 to 10 mm. A surface of each intermediate transfer roller 64 is covered by an electrically conductive elastic material (e.g., EPDM, urethane foam, or the like). With this, it is possible to uniformly apply the high voltage to the intermediate transfer belt 61. In the preset embodiment, a transfer electrode is of a roller form. However, the present embodiment is not limited to this. Alternatively, the transfer electrode can be of another form such as brush.

As described above, the electrostatic images on the photoreceptor drums 3 are made visible with respective color phases, and then transferred to the intermediate transfer belt 61 so as to be on top of one another, thereby obtaining a superimposing image. Then, as the intermediate transfer belt rotates, the transfer roller 10 (later described) causes transfer of the superimposing image to a sheet, the transfer roller 10 being provided at a point where the sheet and the intermediate transfer belt 61 make contact with each other.

At this time, (i) the intermediate transfer belt 61 and the transfer roller 10 are pressed down against each other at a predetermined nip, and (ii) the transfer roll 10 receives a voltage (which is a high voltage having an opposite polarity (+) to a charge polarity (−) of the toners), so as to cause the toner transfer to the sheet. In order that the transfer roller 10 may be constantly nipped, it is configured such that one of the transfer roller 10 and the intermediate transfer belt driving roller 62 is made from a hard material (metal or the like), and the other one of the transfer roller 10 and the intermediate transfer belt driving roller 62 is made from a soft material such as an elastic roller (elastic rubber roller, resin-foam roller, or the like).

As described above, the intermediate transfer belt cleaning unit 65 removes and collects residual toner (i) or (ii), because the residual toner (i) or (ii) is blended with a toner to be used in a following step, the residual toner (i) being a toner adhering to the intermediate transfer belt 61 due to the contact made between the intermediate transfer belt 61 and the photoreceptor drums 3, and the residual toner (ii) being a toner failing to be transferred onto the sheet by the transfer roller 10 and thereby left on the intermediate transfer belt 61. The intermediate transfer belt cleaning unit 65 includes, for example, a cleaning blade as a cleaning member being in contact with the intermediate transfer belt 61. The intermediate transfer belt 61 with which the cleaning blade is in contact is outwardly supported, from its rear surface, by the intermediate transfer belt driven roller 63.

The paper feeding cassette 81 is a tray for storing a recording sheet (sheet) for use in image forming. The paper feeding cassette 81 is provided below the exposure unit 1 of the apparatus main unit 110. The manual paper feeding tray 82, which is provided to a lateral side of the apparatus main unit 110, can also store a recording sheet for use in image forming.

The in-body delivery tray 91, which is provided in an upper part of the apparatus main unit 110, is a tray for receiving a post-printing recording sheet of any size from A5 to A3. On the other hand, a side delivery tray provided to the lateral side of the apparatus main unit 110 is a tray for receiving a post-printing recording medium such as an envelope smaller than A5 size or a recording sheet smaller than A5 size subjected to printing. The side delivery tray is foldable.

The paper feeding and conveying mechanism 9 is provided for sending, to the delivery tray 91 or 92 via the transfer roller 10 and the fixing unit 7, a sheet stored in the paper feeding cassette 81 or the manual paper feeding tray 82. The paper feeding and conveying mechanism 9 includes (i) a paper conveyance path S, (ii) pickup rollers 11*a* and 11*b*, which are provided close to the paper conveyance path S, (iii) a plurality of conveyance roller pairs 12*a* through 12*d*, (iv) registration rollers 13, and the like.

The conveyance roller pairs 12*a* through 12*d* are of a small roller for enhancing and supporting a sheet transportation. The plurality of the conveyance roller pairs 12*a* through 12*d* are provided along the paper conveyance path S. The pickup rollers 11*a* are provided close to an edge of the paper feeding cassette 81. The pickup rollers 11*a* pick up, from the manual paper feeding tray 82, one sheet at a time and feed it to the paper conveyance path S. Similarly, the pickup rollers 11*b* are provided close to an edge of the manual paper feeding tray 82, and pick up, from the manual paper feeding tray 82, one sheet at a time and feed it to the paper conveyance path S. It is designed that in the paper feeding and conveying mechanism 9, the recording sheet is transported using a center of the paper conveyance path S as a reference.

The image forming section 100 includes a control section, which is not illustrated. The control section carries out control of an operation of the image forming apparatus 100, i.e., control of an operation of the main apparatus unit 110 and that of the document reading apparatus 130. For example, the control section includes CPU, ROM, RAM, a nonvolatile memory, an input circuit, and an output circuit.

ROM contains control programs which are processes to be sequentially executed by CPU. RAM provides a work area for processing. The nonvolatile memory stores a backup of data necessary for the control. The input circuit receives an input signal from a sensor and/or a switch, and includes an input buffer and an A/D conversion circuit. The output circuit includes a driver for driving a load such as a motor, a solenoid, a lamp, or the like.

The control section receives a print request, and carries out, based on the print request, (i) selecting one of the paper feeding cassette 81 and the manual paper feeding tray 82, and (ii) causing the pickup rollers 11*a* or 11*b* to feed recording sheet to the paper conveyance path S. Then, the conveyance roller pair 12*a* provided to the paper conveyance path S transports the recording sheet to the registration rollers 13. When the registration rollers 13 receive a front end of the recording sheet, the control section stops a rotation of the registration rollers 13 temporally. Then, the control section restarts the rotation of the registration rollers 13 at timing at which the image information on the intermediate transfer belt 61 is aligned to the front end of the recording sheet. As such, the recording sheet is transported so as to be passed through between the intermediate transfer belt unit 6 and the transfer roller 10 at timing at which the image information on the intermediate transfer belt 61 is aligned to the front end of the recording sheet. Thus, as the recording sheet is passed through between the intermediate transfer belt unit 6 and the transfer roller 10, the toner image corresponding to the image information is transferred onto the recording sheet. After this, the recording sheet is transported to the fixing unit 7 so that the toner image on the recording sheet is fixed.

In a case of one-sided printing, the control section causes the recording sheet passed through the fixing unit 7 to be fed to a partial conveyance path S1, which is a part of the paper conveyance path S and extended between the fixing unit 7 and delivery trays 91 and 92. The recording sheet transported via the partial conveyance path S1 is delivered to one of the in-body delivery tray 91 and the side delivery tray 92, depending on a size of the recording sheet. The recording sheet of any size from A5 to A3 is delivered to the in-body delivery tray 91, while the recording sheet of a size smaller than A5 is delivered to the side delivery tray 92. A method for switching a delivery destination according to a size of the recording sheet is later delivered.

In a case of two-sided printing, on the other hand, the control section causes the recording sheet passed through the fixing unit 7 to be fed to an inversion partial conveyance path S2, which is a part of the paper conveyance path S and extended between the fixing unit 7 and the registration rollers 13. Thus, image forming can be carried out onto a second surface of the recording sheet. The recording sheet being transported via the inversion partial conveyance path S2 is received by the registration rollers 13. As in the case of one-sided printing, the registration rollers 13 causes the recording sheet to be passed through between the intermediate transfer belt unit 6 and the transfer roller 10 at timing at which image information on the intermediate transfer belt 61 is aligned to the front end of the recording sheet. Thus, the toner image corresponding to the image information is transferred onto the recording sheet. After this, the recording sheet is transported to the fixing unit 7 so that the toner image on the recording sheet is fixed. Thereafter, as in the case of the one-sided printing, the recording sheet is fed to the partial conveyance path S1 extended between the fixing unit 7 and the delivery trays 91 and 92. Then, the recording sheet is delivered to one of the in-body delivery tray 91 and the side delivery tray 92, depending on a size of the recording sheet.

(Summary of Document Reading Apparatus)

Figure 3:
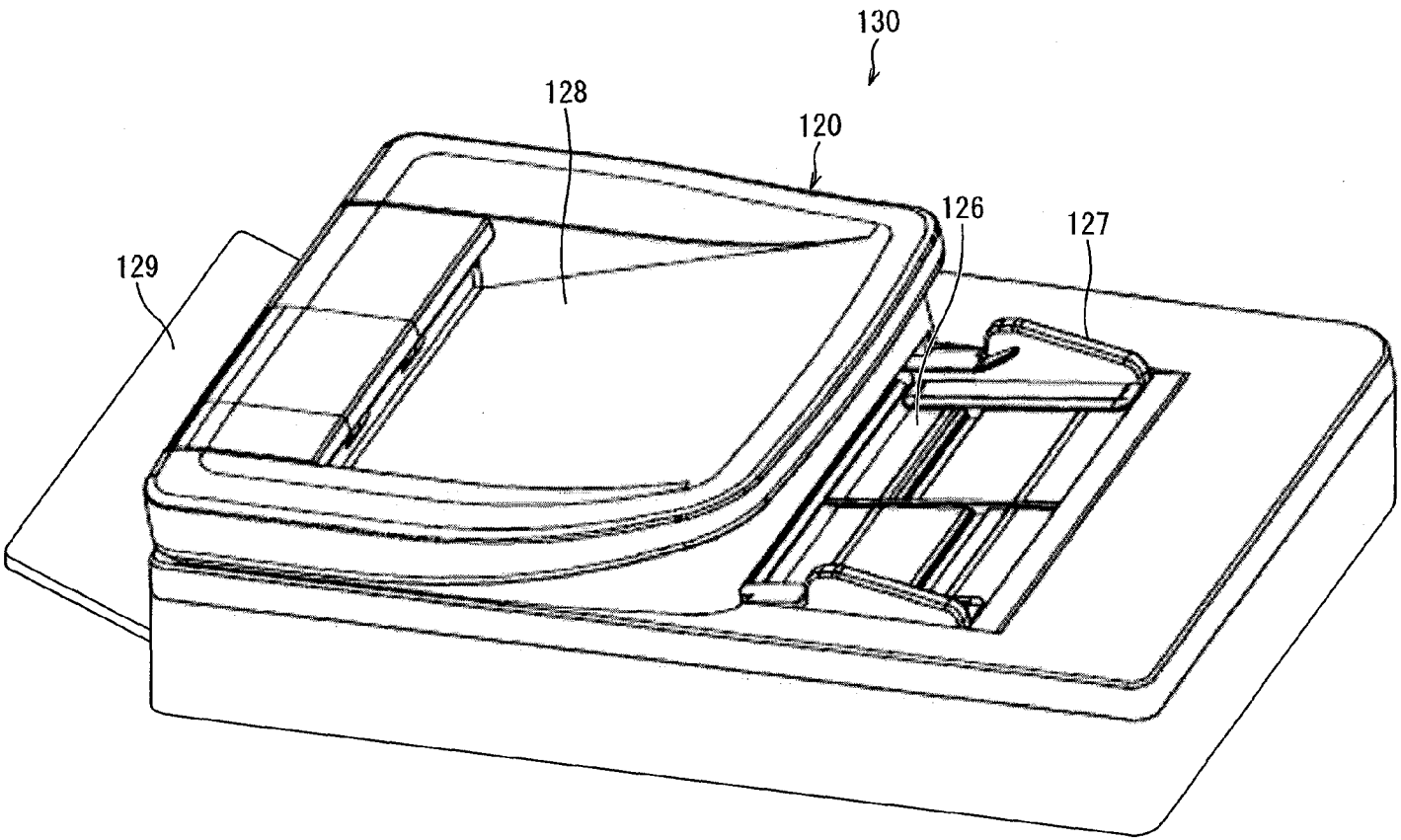
FIG. 3 is a perspective view showing an exterior appearance of the document reading apparatus.
Figure 4:
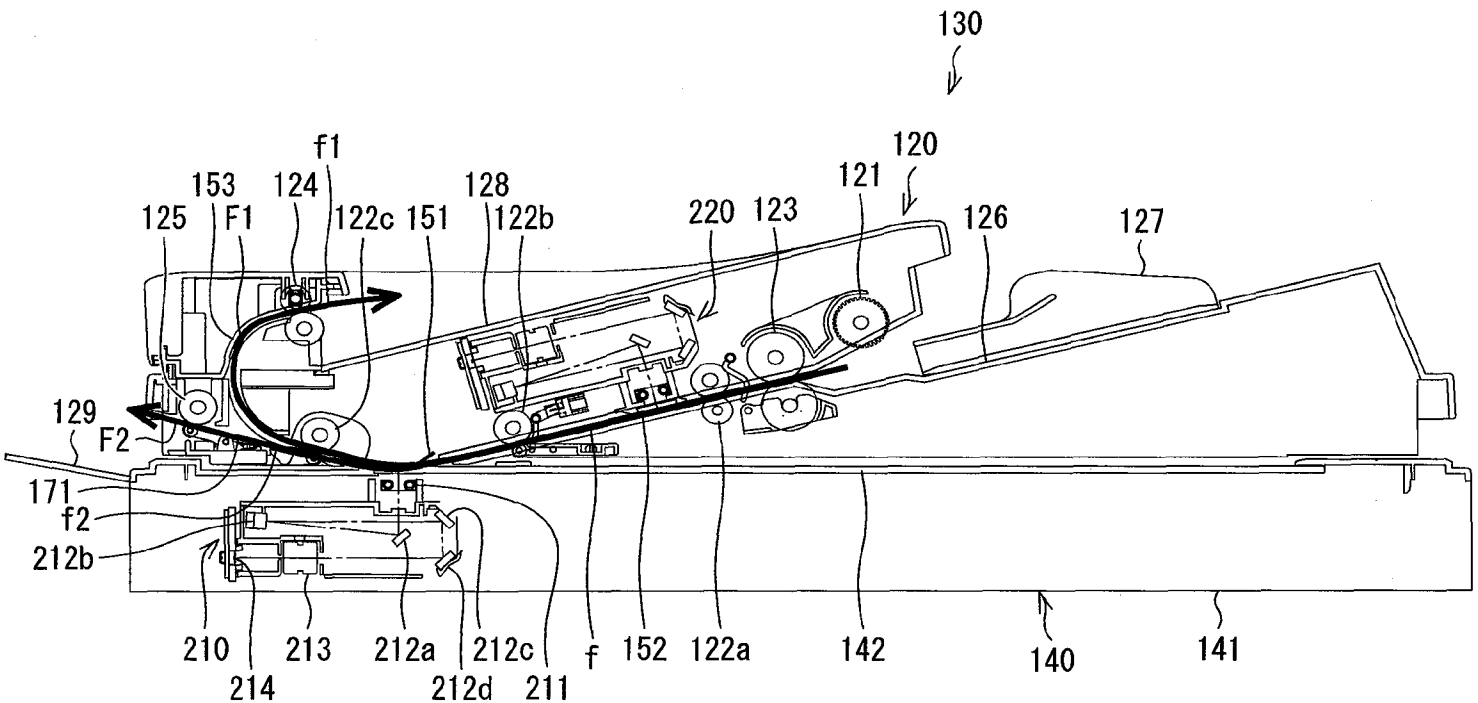
FIG. 4 is a vertical cross sectional view schematically showing the document reading apparatus.

FIG. 3 is a perspective view showing an exterior part of the document reading apparatus 130 in accordance with the present embodiment, which document reading apparatus 130 includes the automatic document feeding apparatus including the sheet conveying apparatus. FIG. 4 is a vertical cross sectional view schematically showing the document reading apparatus 130 shown in FIG. 3.

As shown in FIG. 4, the document reading apparatus 130 of the present embodiment includes (i) the automatic document feeding apparatus (ADF) 120, (ii) a first image reading apparatus 210, (iii) a second image reading apparatus 220, and (iv) a main scanning section 140 for housing the first image reading apparatus 210.

The ADF 120 causes a document to be automatically transported along a document conveyance path F1 or F2 indicated by a bold arrow. The first image reading apparatus 210 scans an image on a first surface of a document being transported thereto, while the second image reading apparatus 220 reads out an image on a second surface of the document being transported thereto.

The first image reading apparatus 210 has a same configuration as the second image reading apparatus 220. Both the first image reading apparatus 210 and the second image reading apparatus 220 are of image reading means of a reduced optical system, which includes a light source 211, first through fourth mirrors 212*a* through 212*d*, a lens 213, and a CCD (image sensor) 214. In FIG. 4, only the members of the first image reading apparatus 210 are indicated by reference numerals. The second image reading apparatus 220 is housed in the ADF 120.

The document reading apparatus 130 is provided on the apparatus main unit 110, and the main scanning section 140 is firmly attached to the apparatus main unit 110. The ADF 120 and the main scanning section 140 are connected to each other by hinges (which are not illustrated), such that the ADF 120 can be moved as if a cover openable and closable with respect to the main scanning section 140 by a turn of the hinges.

The main scanning section 140 mainly includes (i) a housing 141, (ii) a platen plate 142 made from a transparent glass plate, and (iii) the first image reading apparatus 210 housed in the housing 141. The main scanning section 140 supports both image scanning by a document fixation method and image reading by a document transfer method, the image scanning by the document fixation method carried out to a document being placed on the platen plate 142 by a user, and the image reading by the document transfer method carried out to a document being automatically transported by the ADF 120.

In a case of scanning a document image by the document fixation method, the first image reading apparatus 210 carries out image scanning by carrying out, while moving at a constant speed, light irradiation to a document being placed on the platen plate 142. In this case, a bottom surface of the ADF 120 serves as a pressing plate for pressing down, from the above, the document being placed on the platen plate 142 of the main scanning section 140.

On the other hand, in a case of reading out a document image by the document transfer method, the first image reading apparatus 210 carries out image reading by carrying out, while remaining at a home position shown in FIG. 4, light irradiation to a document being transported and passed through, by the ADF 120, above the home position. The ADF 120 includes a reading guide 151 for pressing down a document, the reading guide 151 being provided in a region where image reading is carried out by the first image reading apparatus 210 remaining at the home position.

The ADF 120 includes, besides the reading guide 151, a document placement tray 126, a document regulating guide 127, a pickup roller 121, a paper feeding roller pair 123, a plurality of conveyance roller pairs 122 (122*a* through 122*c*), the upper document delivery tray 128, the side document delivery tray 129, the delivery roller pairs 124 and 125, and a plurality of conveyance guides for constituting the document conveyance paths F1 and F2. The second image reading apparatus 220 is formed as a unit, and provided on an inner side of a substantially U-shaped curve of the document conveyance path F1.

The document placement tray 126 is a table for placing thereon the document to be transported by the ADF 120. The document regulating guide 127 is provided for regulating a position of the document being placed on the document placement tray 126. It is designed that in the ADF 120, the document is transported using respective centers of the document conveyance paths F1 and F2 as references for the positional regulation.

The pickup roller 121 is provided for conveying, one by one into the ADF 120, documents being placed on the document placement tray 126. In the present embodiment, the pickup roller 121 is temporarily halted each time when it has finished feeding one document, and driven again at time when it starts feeding another document.

The paper feeding roller pair 123 is provided for feeding the document picked up by the pickup roller 121 to the document conveyance path F1 or F2.

The document conveyance path F1 is a conveyance path which has a substantially U-shaped curve formed upwardly, the document conveyance path being extended between the document placement tray 126 and the upper document delivery tray 128. On the other hand, the document conveyance path F2 is a conveyance path being extended between the document placement tray 126 and the side document delivery tray 129. In the present embodiment, the document conveyance path F2 has a moderate curve.

Specifically, the document conveyance paths F1 and F2 share a common conveyance path f being extended to a region where the first image reading apparatus carries out image reading. On a downstream side of the region, the document conveyance paths F1 and F2 are constituted by respective branch conveyance paths f1 and f2, thereby being branched from each other.

Figure 5:
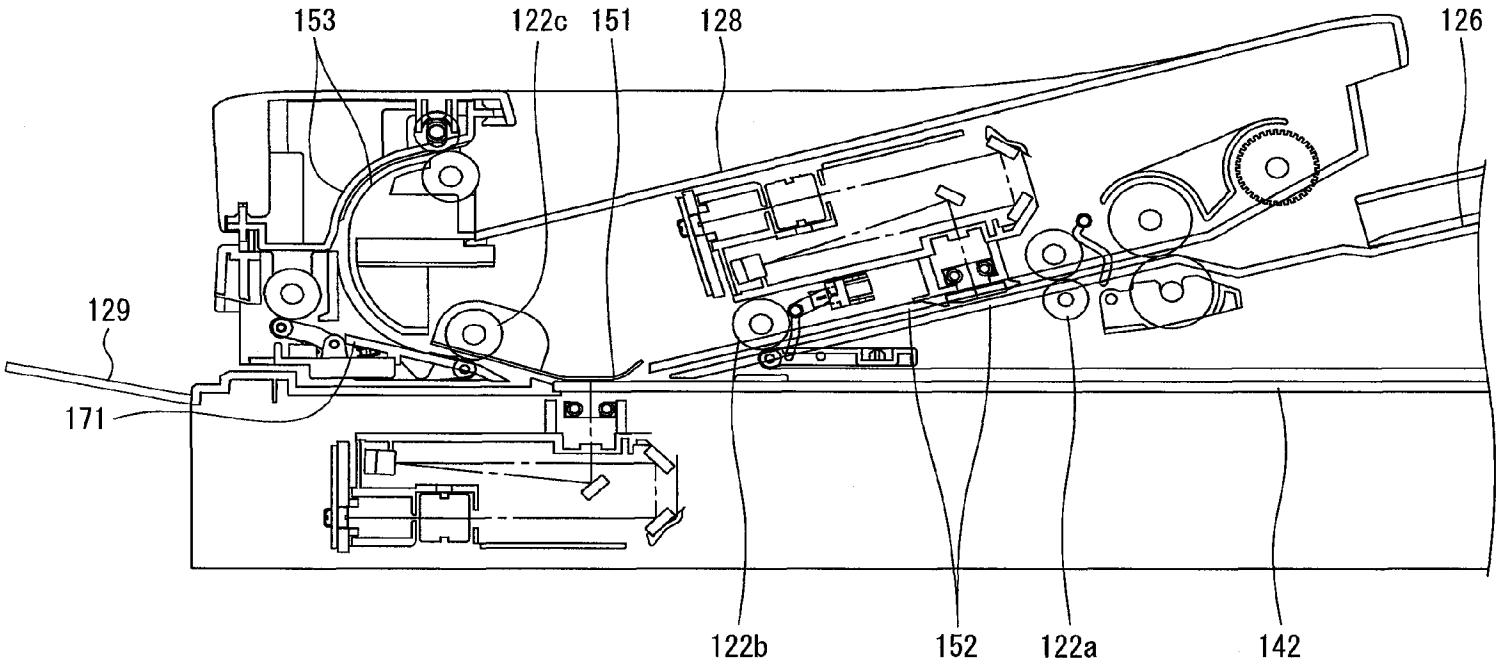
FIG. 5 is a vertical cross sectional view of a main section, showing a transporting guide in an ADF included in the document reading apparatus.

As shown in FIG. 5, the common conveyance path f is defined by (i) a straight conveyance guiding section 152, which is constituted by a upper and lower conveyance guiding pair, and extended between the document placement tray 126 and image reading-out guide 151, as well as by (ii) the image reading-out guide 151 and the platen plate 142. The branch conveyance path f1 is defined by a U-shaped conveyance guide section (first sheet conveyance guide) 153, which is constituted by the upper and lower conveyance guiding pair, and extended between the image reading-out guide 151 and the upper document delivery tray 128. On the other hand, the branch conveyance path f2 is defined by a flat guide (second sheet conveyance guide) 171, which is extended from (i) a lower end of an opening 170 being formed in a first lower conveyance guide 153*c* (later described) of the U-shaped conveyance guiding section 153 to (ii) a direction of the side document delivery tray 129.

The conveyance roller pairs 122*a* through 122*c* are provided for transporting, along the conveyance guiding sections 152 or 153, the document having fed to the document conveyance path F1 or F2. Then, the document having passed through the conveyance roller pair 122*c* is fed to one of the branch conveyance paths f1 and f2 via a branch therebetween, and transported thereon. Such path switching between the branch conveyance paths f1 and f2 is carried out without use of a conveyance path switching member including a gate, and this is later described.

The image reading apparatus 220 carries out, in a case where the user requests two-sided image reading, image reading to an image on a second surface of the document being transported on the document conveyance path F.

Both the upper document delivery tray 128 and the side document delivery tray 129 are provided so as to store, on top of one another, documents having been transported to them via corresponding ones of the document conveyance paths F1 and F2. The paper delivery roller pair 124 is provided for causing the documents, which have been transported on the document conveyance path F1, to be delivered to the upper document-delivery tray 128. The paper delivery roller pair 125 is provided for causing the documents, which have been transported on the document conveyance path F2, to be delivered to the side document-delivery tray 129.

(Main Section of Document Reading Apparatus)

In the document image reading apparatus 130 of the present embodiment, the ADF 120 transports a document such as a business card of a 55 mm×91 mm size and/or a resin-based card of a 55 mm×85 mm size, thereby allowing for image reading of a document image. Thus, it is configured that the ADF 120 can transport the business card and/or the resin-based card by longitudinal transportation. In the longitudinal transportation, a longitudinal direction of the document is transported in a way that a longitudinal direction of the document is in a conveying direction of the document. Specifically, it is designed that (i) paired axes of each of the conveyance roller pairs 122*a* through 122*c* are provided from each other at such a distance which improves and supports a transportation of a minimum size document to be handled in the image reading apparatus 130 of the present embodiment, and (ii) roller members on each axis of the conveyance roller pairs 122 *a* through 122*c* are provided to each other at such a distance which improves and supports the transportation of the minimum document to be handled in the image reading apparatus 130 of the present embodiment.

Figure 6:
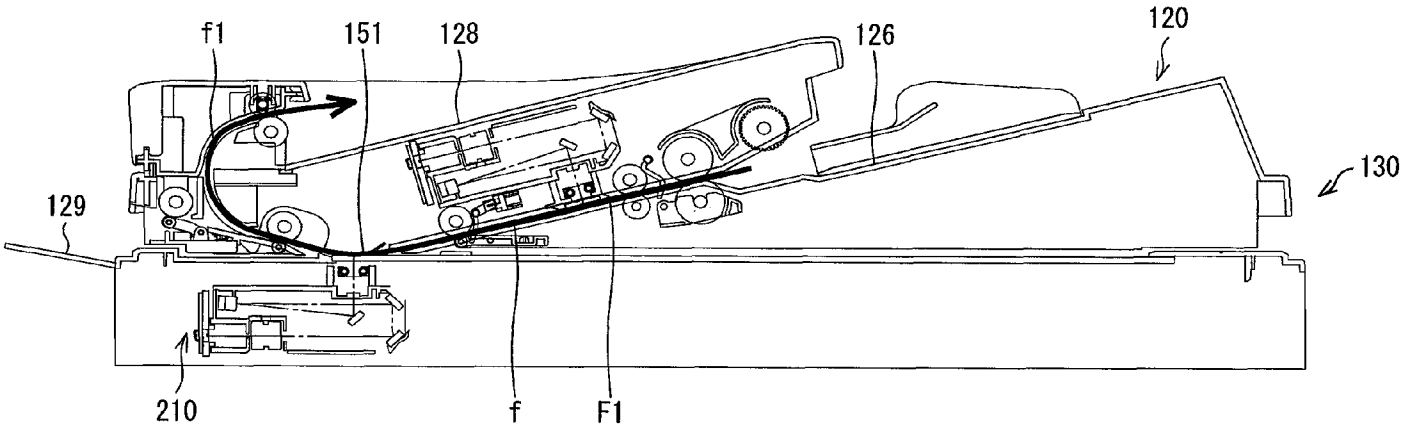
FIGS. 6(*a*) and 6(*b*) are views showing respective document conveyance paths provided in the automatic document feeding apparatus of the document reading apparatus.
Figure 6:
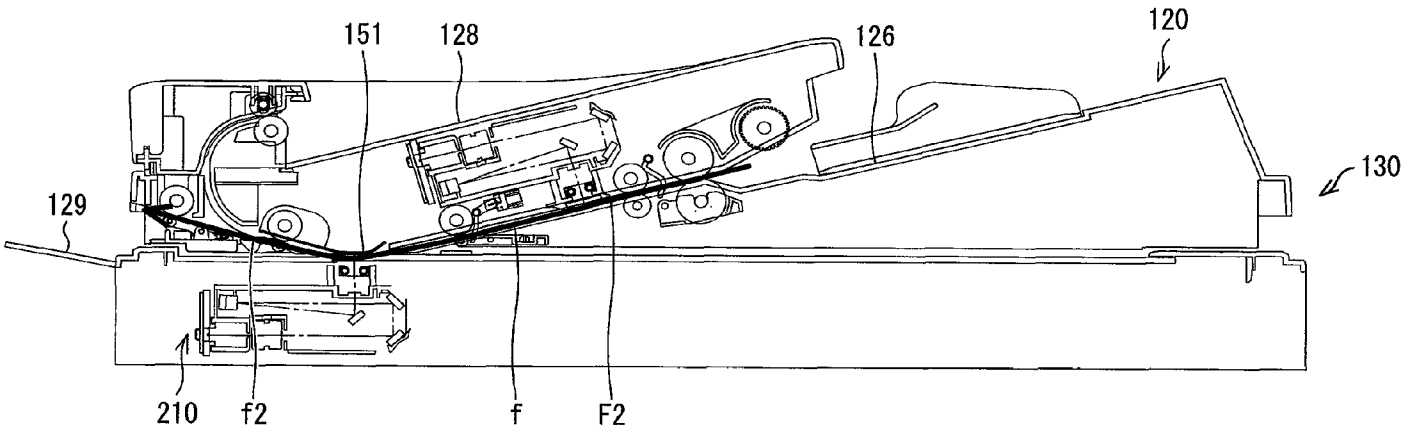

Thus, in the document reading apparatus 130 of the present embodiment, the ADF 120 operates as follows. In a case where the document is a normal document made from a normal sheet having any size from A5 to A3, the ADF 120 transports the document on the document conveyance path F1 having the U-shaped curve and the branch conveyance path f1, and delivers the document to the upper document delivery tray 128, as shown in FIG. 6(*a*). On the other hand, in a case where the document is a small size document not larger than a predetermined size (i.e., a size of that direction (width direction) of the document, which is orthogonal to the conveying direction of the document, is smaller than a size of a transverse direction of an A5 sheet, and examples of the small size document include the business card, the card, and an envelope), the ADF 120 transports the document on the document conveyance path F2 being close to parallel and having the branch conveyance path f2, and delivers the document to the side document delivery tray 129.

As described above, with a configuration which includes, at a branch point between the conveyance paths f1 and f2, a switching section including a gate, and causes a control section to carries out control of the path switching between the conveyance paths f1 and f2, based on a detection of a thickness and/or size of the document being transported, then, there is a problem in that cost increase is caused, and an apparatus has an increased size.

Figure 1:
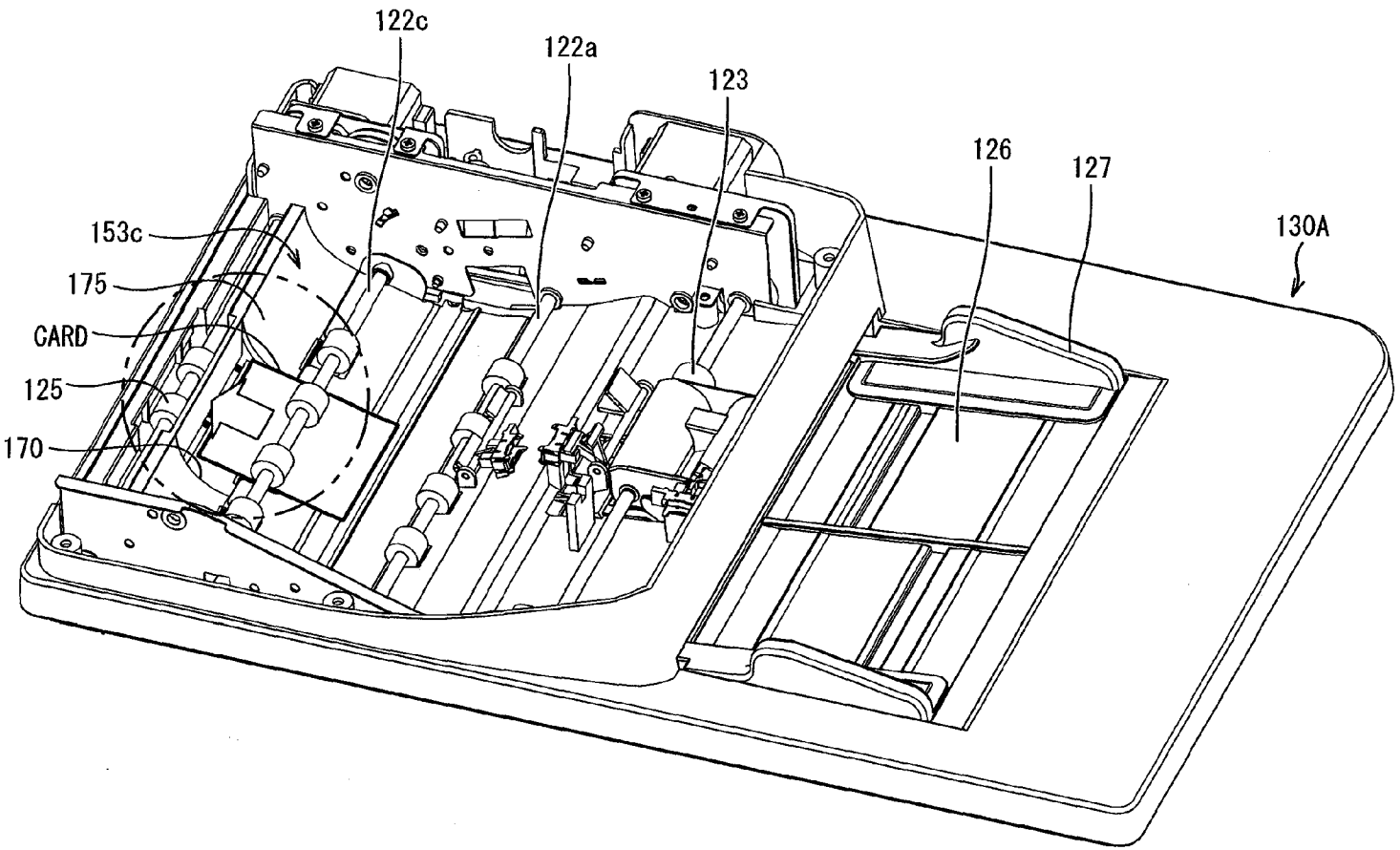
FIG. 1 is a perspective view taken with respect to a document reading apparatus employing a sheet conveying apparatus, and showing an automatic document feeding apparatus in the document reading apparatus of one embodiment of the present invention, wherein an upper constituent member including an upper document delivery tray is removed from the automatic document feeding apparatus.

In view of the problem, the ADF 120 of the document reading apparatus 130 of the present embodiment realizes the path switching by a configuration shown in FIG. 1. The configuration has, in a central part of that width direction of the lower conveyance guide 153*c* of the U-shaped conveyance guiding section 153 which is orthogonal to a document conveying direction, the opening 170 for blocking passage of a document not smaller than an A5 size (normal document size), and allowing only passage of the small size document (in FIG. 1, a card is illustrated as the small size document) not larger than the predetermined size.

Figure 7:
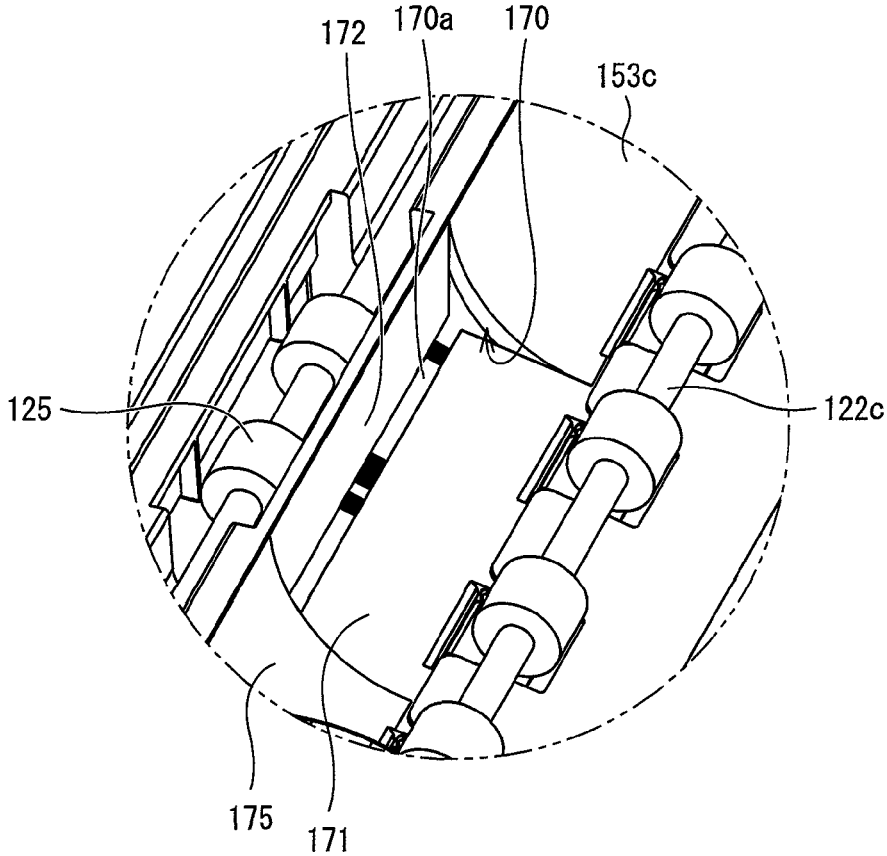
FIG. 7 is an enlarged view showing a part encircled in FIG. 1.
Figure 8:
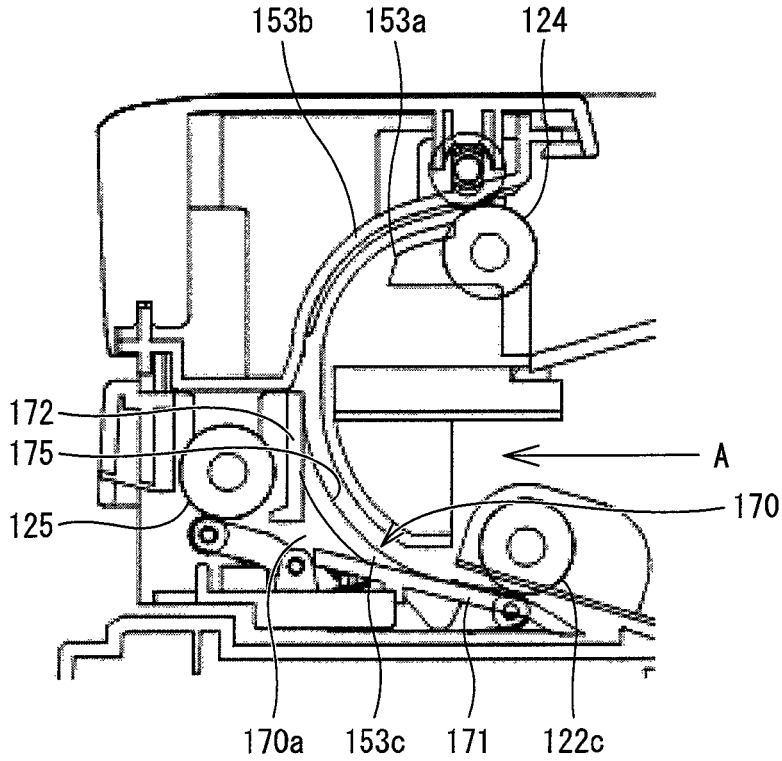
FIG. 8 is a cross section view showing a main section where there is provided a U-shaped conveyance guiding section in the automatic document feeding apparatus of the document reading apparatus.
Figure 9:
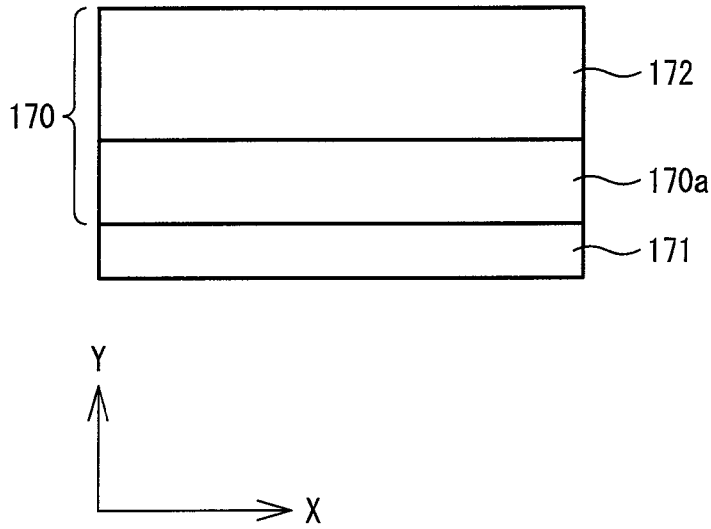
FIG. 9 is a view showing, from a direction of an arrow A in FIG. 8, an opening formed in the automatic document feeding apparatus of the document reading apparatus.

FIG. 1 is a perspective view showing the ADF 120 from which an upper constituent member, including the upper document delivery tray 128, is removed. FIG. 7 is an enlarged view showing a part encircled in FIG. 1. FIG. 8 is a cross sectional view showing a main section of the ADF 120 in which the U-shaped conveyance guiding section 153 is provided. FIG. 9 is a view showing the opening 170 from a direction of an arrow A in FIG. 8.

As shown in FIG. 8, the U-shaped conveyance guiding section 153 is constituted by (i) the upper conveyance guide 153*a* provided on an inner side of the U-shaped curve, (ii) the lower conveyance guide 153 provided on an outer side of the U-shaped curve and constituting an upper half part of the U-shaped conveyance guiding section 153, and (iii) the lower conveyance guide 153*c* provided on the outer side of the U-shaped curve and constituting a lower half part of the U-shaped conveyance guiding section 153. The lower conveyance guide 153*b* has a guiding surface, an entire part of which is formed by a curved surface of a conventional curvature. In FIG. 1, only the lower conveyance guide 153*c*, from which the upper conveyance guide 153*a* and the lower conveyance guiding section 153*c* are removed, is shown.

As shown in FIGS. 7 and 8, (i) the lower conveyance guide 153*c* has a guiding surface 175 which is formed by a curved surface having a conventional curvature, and (ii) the central part of the width direction of the guiding surface 175 has the opening 170, having the size which allows passage of only the small size document. The opening 170 is formed in that part of the central part of the width direction which receives a front end of the document having passed through the conveyance roller pair 122*c*.

The opening 170 is good as long as it can pass therethrough one small size document. As such, the opening 170 can be a slit opening, having a projection plane of a slit shape when viewed in a document feeding direction. However, in consideration of a warpage of the small size document and easy transportation, it is preferable that the opening 170 be a rectangular opening.

In the present embodiment, as shown in FIGS. 7 and 8, a part of the central part of the width direction of the lower conveyance guide 153*c* has the opening 170, whose projection plane has the rectangular shape when viewed in the document feeding direction (sheet feeding direction).

Thus, the lower conveyance guide 153*c* has the opening 170 as described above. Consequently, the opening 170 passes therethrough the document in a case where the document being transported by the ADF 120 is the small size document, having a size of the width direction (the direction X in FIG. 9) orthogonal to the conveying direction being smaller than the size of the width direction (which is the same as the longitudinal direction) of the opening 170.

At a bottom end of the opening 170, there is provided the flat guide 171 which is plainly extended between the bottom end of the opening 170 and the outer side of the U-shaped curve. By this, the branch conveyance path f2 is constituted. With the configuration providing such flat guide 171 at the bottom end of the opening 170, the document having passed through the opening 170 is transported along the flat guide 171.

In the present embodiment, it is designed such that the conveyance roller pair 122*c*, which is provided immediately preceding to the opening 170 on the upstream side in the document conveying direction, has a document conveying direction in parallel to a guiding surface of the flat guide 171. In other words, it is designed such that the conveying direction of the small size document, the small size document being transported along the guiding surface of the flat guide 171, and the feeding direction of the document, the document being fed to the curved conveyance path provided in the document conveying direction of the conveyance roller pair 122*c*, are parallel with each other.

In a case where the conveying direction is changed due to the conveyance path being curved on an upstream and/or downstream side of the opening 170, for example, the small size document would be warped at its front end. On the other hand, this configuration has such a problem in that a hard document of a small size cannot be warped along the curve of the conveyance path. As such, the small size document is fed to the opening 170 while its front end being held up. As a result, the entire small size document is uplifted, so that a central part and/or rear end side of the small size document cannot be passed through the opening 170, thereby causing document jamming.

With the present embodiment having the above configuration (the conveyance roller pair 122*c* has the document conveying direction in parallel to the guiding surface of the flat guide 171), in contrast, the small size document is passed through the opening 170 while being kept in the same direction in which it has been fed to the cured conveyance path. Thus, it is prevented from occurring that (i) the small size sheet is warped at its front side or (ii) the hard document of the small size is uplifted while being transported. It is therefore possible that the small size document be freely passed through the opening 170, and delivered to the side document delivery tray 129 via the branch conveyance path f2.

On the other hand, in a case where the document being transported by the ADF 120 is a normal document, having a size of the width direction orthogonal the conveying direction being larger than a size of the width direction of the opening 170, the opening 170 does not allow passage of the normal document. As such, the normal document is placed on touch with the guiding surface 175 of the conventional curvature being provided on both sides of the opening 170, transported along the guiding surface 175, and delivered to the upper document delivery tray 128 via the branch conveyance path f1.

In a case where the opening 170 of the rectangular shape is configured such that a size of the transverse direction (a thickness direction of the document being passed through the opening 170) of the opening 170 is large, i.e., the opening 170 of the rectangular shape opens largely to a conveying direction (a direction Y in FIG. 9) of the normal document being transported on the branch conveyance path f1, there is a risk that a front end of the normal document is stuck in the upper end of the opening 170.

In view of this, the present embodiment is arranged such that the wall section 172 for covering the upper part of the opening 170 is provided. The wall section 172 has a shape being plainly extended from the upper end of the opening 170 to the outer side of the U-shaped curve. The wall section 172 is provided to a downstream side (the upper end) of the opening 170 of the rectangular shape in the conveying direction of the sheet being transported on the curved conveyance path. The wall section 172 is extended in a direction tangent to the curved guiding surface, so as to cover the downstream side (an upper part) of the opening 170 in the conveying direction.

With such wall section 172, it is configured so that (i) the lower end of the wall section 172 defines an upper end of an actual opening 170*a* for passing therethrough the small size document, and (ii) the actual opening 170*a* can be provided at a position more outer on the outer side of the U-shaped curve, as compared to the guiding surface 175 of the branch conveyance path f1 for transporting the normal document. Thus, even in a case where the front end of the normal document being transported on the branch conveyance path f1 enters the opening 170, (i) it is prevented that the front end of the normal document even enters the actual opening 170*a*, and (ii) the normal document is guided by the wall section 172 so as to be freely transported on the branch conveyance path f1. Thus, it is possible to reduce as much as possible occurrence of a failure that the normal document is stuck in the upper end of the opening 170.

Thus, in the document reading apparatus 130 of the present embodiment, the ADF 120 operates as follows. In a case where the document is in a form of a normal sheet having any size from A5 to A3, the ADF 120 transports the document always via the document conveyance path F1 shown in FIG. 6(*a*) which has the branch conveyance path f1 and the U-shaped curve, so as to deliver the document to the upper document delivery tray 128. On the other hand, in a case where the document is a small size document such as a business card, a card, an envelop, or the like, the ADF 120 transports the document always via the document conveyance path F2 shown in FIG. 6(*b*) which has the branch conveyance path f2, so as to deliver the document to the side document delivery tray 129.

Figure 10:
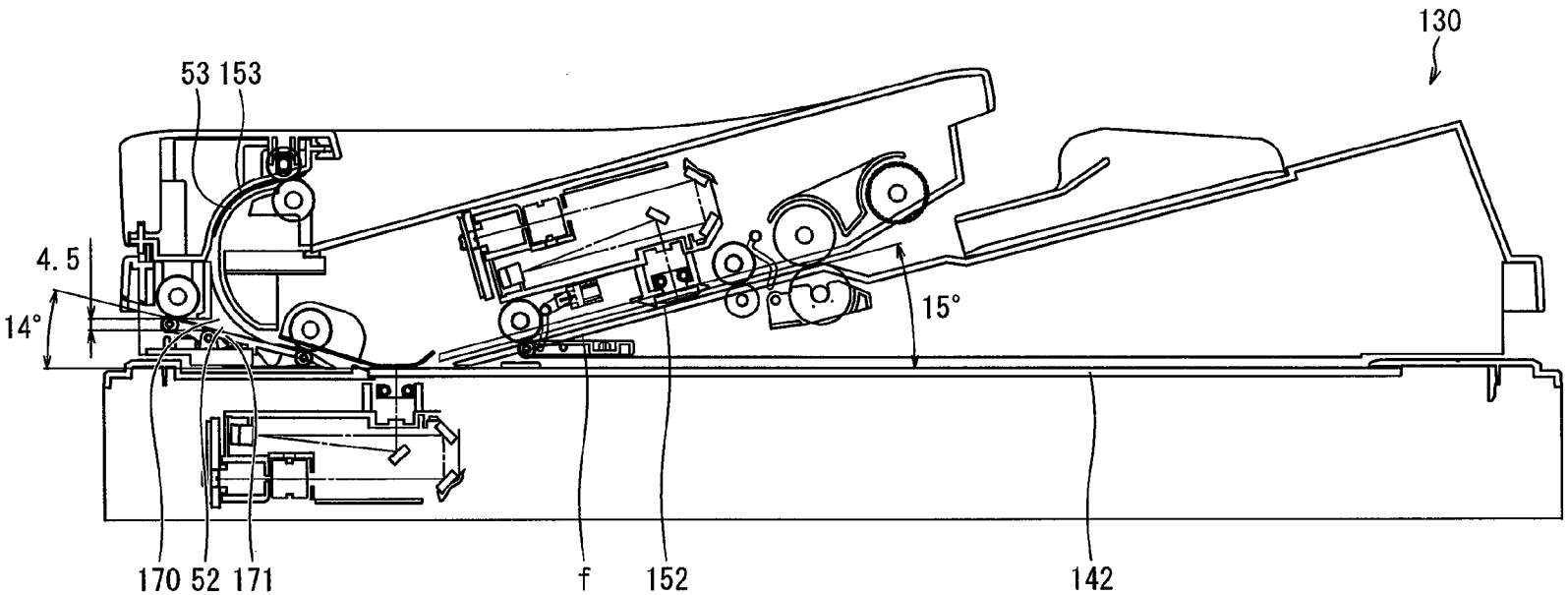
FIG. 10 is a vertical cross section view showing a document reading apparatus in accordance with Example.

With reference to FIG. 10, the following description discusses a document reading apparatus 130 of an example which includes a sheet conveying apparatus of First Embodiment. FIG. 10 is a cross sectional view showing the document reading apparatus 130 of the present example.

As shown in FIG. 10, it was configured such that (i) an angle of a straight conveyance guiding section 152 to a platen plate 142 was 15°, (ii) an angle of a flat guide 171 to the platen plate 142 was 14°, (iii) a size of a longitudinal direction of an opening 170 was 65 mm, which included a 5-mm margin to a 55-mm business card size at both ends of the longitudinal side of the opening 170, and (iv) a size of a transversal side of an actual opening 170*a* was 4.5 mm. Paper delivery test and image reading test were carried out for the configuration by use of a small size document.

In the present example, (i) a small size document having a 55 mm×91 mm business card size and made from PET having a thickness of 0.5 mm and (ii) a small size document having a 55 mm×91 mm business card size and made from PC (polycarbonate) having a thickness of 0.5 mm were prepared. With the use of the small size documents, it was tested whether normal document delivery was carried out or not, and whether normal image reading by the first image reading apparatus 210 was carried out. Whether the normal image reading was carried out or not was determined, based on visual observation of a printed image on a recording sheet and an image obtained in a personal computer being connected to the image forming apparatus 100. In a case where neither of the images had any blur, it was determined that the normal image reading was carried out. In the present example, it was demonstrated that both of the documents were delivered successively.

In the present example, document transportation test by longitudinal transportation was also carried out by using, as the normal document, a document (e.g., documents of A5, B5, A4, B4, and A3 sizes) for use in the apparatus of the present invention. It was demonstrated that the documents were delivered to the upper document delivery tray 128 successively.

In the apparatus of the present example, it was designed that the opening 170 had a size of 65 mm in the longitudinal direction (width direction). However, the present example is not limited to this. Alternatively, the opening 170 could have any size in the longitudinal direction, provided that the opening 170 can freely pass therethrough the small size document being transported by longitudinal transportation, the small size document including a card such as a business card, a member ID card, or the like, and an envelop. For example, in a case where the small size document includes a postcard, it should be designed that the longitudinal direction of the opening 170 has a size that includes, at the transversal ends of the opening 170, a 5 mm margin to a size of the transverse direction of the postcard.

However, if the size of the width direction of the opening 170 is set too large, the following is caused. Even though it is desired that a normal document such as an A5 document or a document having a close size to the A5 document be delivered to the upper document delivery tray 128, a front end of the A5 document or that of the document having the close size to the A5 document is easily stuck in the opening 170. Thus, there is a risk that a document jamming is caused. In view of this, it should be designed that the width direction of the opening 170 has a size, which allows passage of the small size document subjected to the image reading by the image reading apparatus 130, and prevents even a minimum one of large size documents, which are desired to be delivered to the upper document-delivery tray 128, from being stuck in the opening 170 so that it can be successively delivered to the upper document-delivery tray 128.

(Main Section of Paper Feeding Conveying Mechanism)

In the image forming apparatus 100 of the present embodiment, even the apparatus main unit 110 can transport a recording sheet such as (i) a recording sheet of a same size as a 55 mm×91 mm business card size or a 55 mm×85 mm card size or (ii) an envelope. Thus, the paper feeding conveying mechanism 9 is configured operable to transport, by longitudinal transportation, a small size recording sheet (which includes the envelope) having the same size as the business card or the card. In the longitudinal transportation, a recording sheet is transported in such a way that a longitudinal direction of the recording sheet is in a conveying direction of the recording sheet.

Specifically, it is designed that (i) paired axes of each of the conveyance roller pairs 12*a* through 12*d* are provided to each other at such a distance which improves and supports a transportation of a minimum size document to be handled in the apparatus main unit 110, and (ii) roller members on each axis of the conveyance roller pairs 12*a* through 12*d* are provided to each other at such a distance which improves and supports the transportation of the minimum document to be handled in the apparatus main unit 110.

In the apparatus main unit 110, the paper feeding conveying mechanism 9 operates as follows. In a case where the recording sheet is a recording sheet in a form of a normal sheet having any size from A5 to A3, the paper feeding conveying mechanism 9 transports a recording sheet via a branch conveyance path s1*a* having a U-shaped curve, and delivers it to the in-body delivery tray 91, as shown in FIG. 2. On the other hand, in a case where the recording sheet is a small size recording sheet (which includes the business card, the card, and the envelop, and has a size in an orthogonal direction to a recording sheet conveying direction which is smaller than a size of a transverse direction of an A5 sheet), the paper feeding conveying mechanism 9 transports the recording sheet via a branch conveyance path s1*b*, and delivers it to the side document delivery tray 92.

Figure 11:
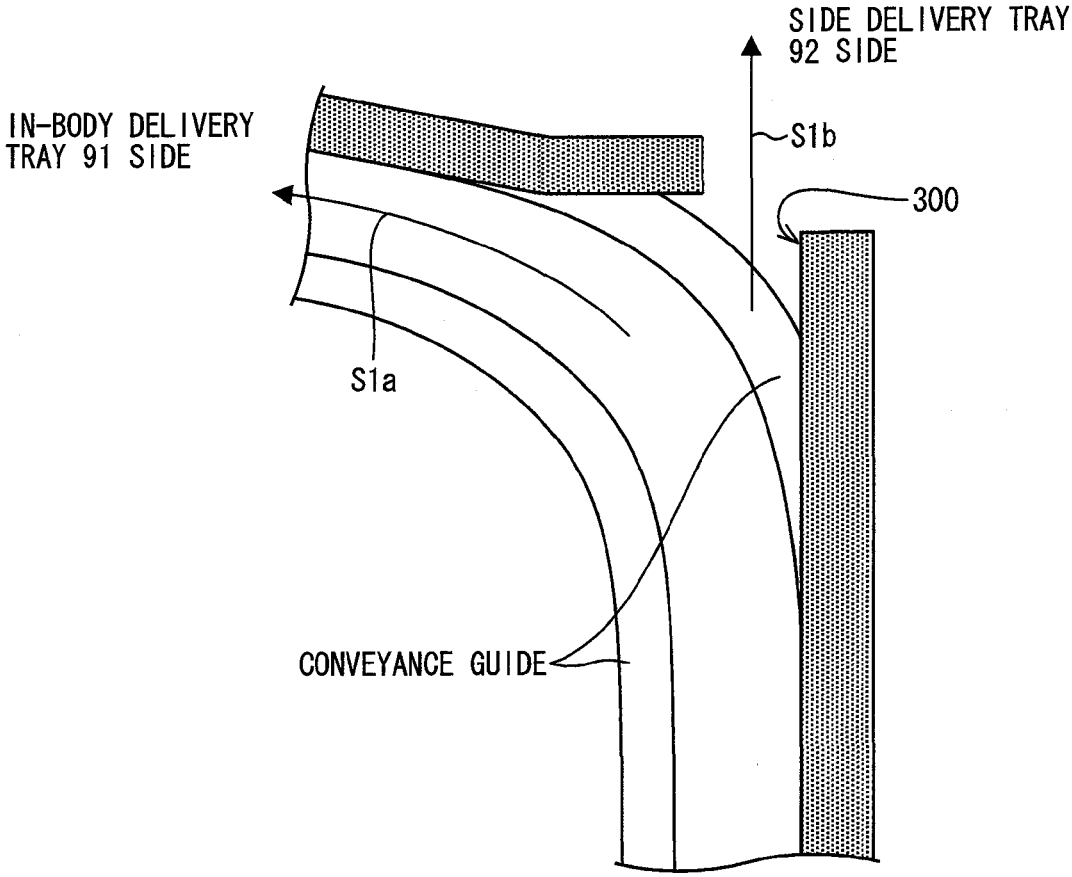
FIG. 11 is an explanation view showing a main section of a paper feeding conveying mechanism including a sheet conveying apparatus, in accordance with one embodiment of the present invention.

As shown I FIG. 11, path switching between the branch conveyance paths s1*a* and s1*b* is carried out by, as in the case with the document reading apparatus 130 described earlier, a configuration which has an opening 300 in a conveyance guide 301 having a U-shaped curve and constituting the branch conveyance path s1*a*, the opening having a size that is passable for only the small size document but not for the normal recording sheet. Even though a detailed configuration is not shown in FIG. 11, as in the case with the opening 170, the opening 300 is formed in that central part of a width direction of the conveyance path which is orthogonal to the paper conveying direction, and which receives the front end of the recording sheet. The conveyance guide 301 has a same design as the opening 170 of the lower conveyance guide 153*a*.

This makes it possible, without the need for a branch switching section such as a gate or the like and a configuration for controlling it, that the recording sheet having any size from A5 to A3 be always delivered to the in-body delivery tray 91, and the recording sheet smaller than A5 sheet be always delivered to the side delivery tray 92.

Second Embodiment

Another embodiment of the present invention is described below with reference to the drawings. For an easy explanation, a member having a same function as the member employed in First Embodiment is given a same reference numeral, and an explanation thereof is omitted.

Figure 12:
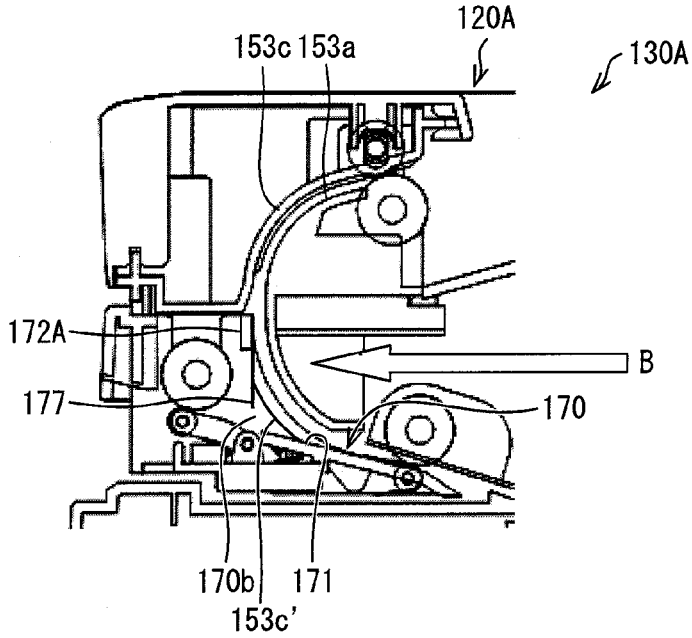
FIG. 12 is a cross sectional view taken with respect to a document reading apparatus employing a sheet conveying apparatus of another embodiment of the present invention, and showing a main section of an automatic document feeding apparatus of the document reading apparatus, in which main section of the automatic document feeding apparatus there is provided a U-shaped conveyance guiding section.

A sheet conveying apparatus of the present embodiment is included in an ADF 120A of a document reading apparatus 130A shown in FIG. 12. The sheet conveying apparatus of the present embodiment may be included, in place of the sheet conveying apparatus of First Embodiment, in the paper feeding conveying mechanism 9 of the apparatus main body 110 of the image forming apparatus 100.

The ADF 120A differs from the ADF 120 of First Embodiment in how a wall section 172 is configured, the wall section 172 being provided at an upper end of an opening 170 in a lower conveyance guide 153*c*' constituting a lower half of a U-shaped conveyance guiding section 153.

In the ADF 120 of First Embodiment, there is a risk that if a size of a transverse direction of an actual opening 170*a* is small, a lower end of the wall section 172, which defines an upper end of the actual opening 170*a*, is touched by a small size document being upwardly warped. If the small size document touches the lower end of the wall section 172, it may be caused that (i) document jamming occurs, or (ii) the small size document is fed into the branch conveyance path f1 and thus delivered into the upper document delivery tray 128. In view of this, a larger size of the transverse direction of the actual opening 170*a* is preferable for passage of the small size document via the opening 170.

As described earlier, however, if it is configured so as not to employ a configuration for covering the opening 170, it is easier that the normal document is stuck in the opening 170. The normal document is larger in size but smaller in thickness than the small size document. Particularly for this reason, a normal document having a weak strength is warped, and a warped part of the normal document enters the opening 170. If the size of the transverse direction of the actual opening 170*a* is large, the same will occurs even in a configuration which employs the wall section 172 for covering the upper part of the opening 170. In view of this, it is difficult to determine the size of the transverse direction of the actual opening 170*a*.

Figure 13:
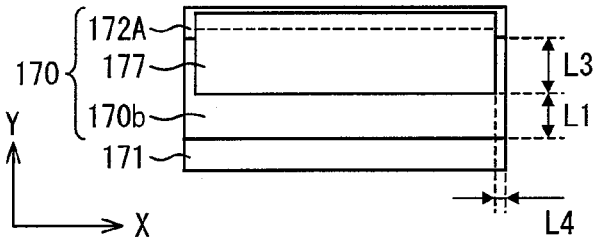
FIG. 13 is a view showing, from the direction of the arrow B in FIG. 12, an opening formed in the automatic document feeding apparatus of the document reading apparatus.
Figure 14:
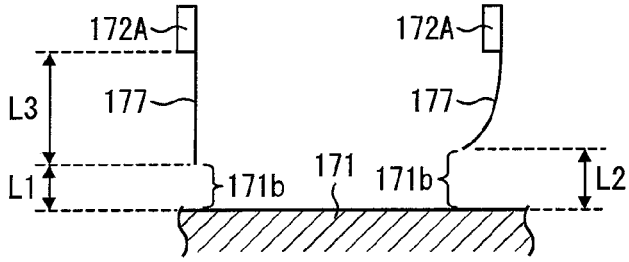
FIG. 14 is a view explaining how a flexible member being provided to the opening operates.

In the ADF 120A of the present embodiment, as shown in FIGS. 13 and 14, the wall section 172 is replaced by a flexible member 177 of a rectangular shape, the flexible member 177 having one longitudinal end attached to the upper end of the opening 170 of the rectangular shape, and the other longitudinal end which is a free end. More specifically, (i) the wall section 172A for covering the upper end of the opening 170 is shortened as compared to the wall section 172 of First Embodiment shown in FIGS. 8 and 9, and (ii) the flexible member 177, which is attached to the wall section 172A and hung therefrom like a curtain, replaces a shortened part of the wall section 172. FIG. 13 is a cross sectional view showing a main section of the ADF 120A in which the U-shaped conveyance guiding section 135A is provided, and FIG. 14 is a view showing the opening 170A from a direction B in FIG. 13.

The flexible member 177 can be made from PET mylar having a thickness of approximately 0.1 mm. The flexible member 177 is attached to the wall section 172A by using a two-sided tape or the like. A measure L4, which is of a distance between the flexible member 177 and a wall surface of a depression 173 having the opening 170A, is set to approximately 1.5 mm. A measure L1, which is of a size of the actual opening 170*b* in the direction Y, the size of the actual opening 170*b* in the direction Y being defined by a distance between the lower end of the flexible member 177 and the flat guide 171, is set to 4.5 mm, for example. In the present embodiment, for example, a size of the flexible member 177 in the direction Y is set to 20 mm. Out of 20 mm, 7 mm of the flexible member 177 is used for the attachment to the wall section 172A, and 13 mm thereof is a non-attachment part hung from the wall section 172A. A measure L1 is a measure of the non-attachment part of the flexible member 177. Note that the numeric values above are merely illustrative.

Thus, it is configured such that the wall section 172A is shortened, and attached with the one end of the flexible member 177 so as to cover the upper part of the opening 170. With the configuration, it is possible to differ that size of the transverse direction of the actual opening 170 which is for the small size document from that size of the transverse direction of the actual opening 170*b* which is for the normal document.

Specifically, the flexible member 177 is provided. As such, even in a case where the small size document is greatly upwardly warped at its front end at time when it is passed through the opening 170, the front end of the small size document does not touch the lower end of the wall section 172A. Instead, the upwardly-warped front end of the small size document touches the flexible member 177, thereby pushing the flexible member 177 in the document conveying direction (toward outer side of the U-shaped curve). Thus, the flexible member 177 is bent in the document conveying direction, and this enlarges the size of the transverse direction of the actual opening 170*b* from L1 to L2 (e.g., L1+2~3 mm). Therefore, the opening 170 can pass therethrough the small size document without any problem.

Thus, the measure L1 of the size of the transverse direction of the actual opening 170*b* is set to a size that allows, even in a case where the normal document is warped in a region where the opening 170 is formed, the normal document not to be stuck by the upper end of the actual opening 170*b*, i.e., the lower end of the flexible member 177. By this, it is possible that a normal document being warped and a small size document being bent be transported without any problem.

Third Embodiment

Still another embodiment of the present invention is described below with reference to the drawings. For an easy explanation, members having same functions as the members employed in First Embodiment are given same reference numerals, and explanations thereof are omitted.

Figure 15:
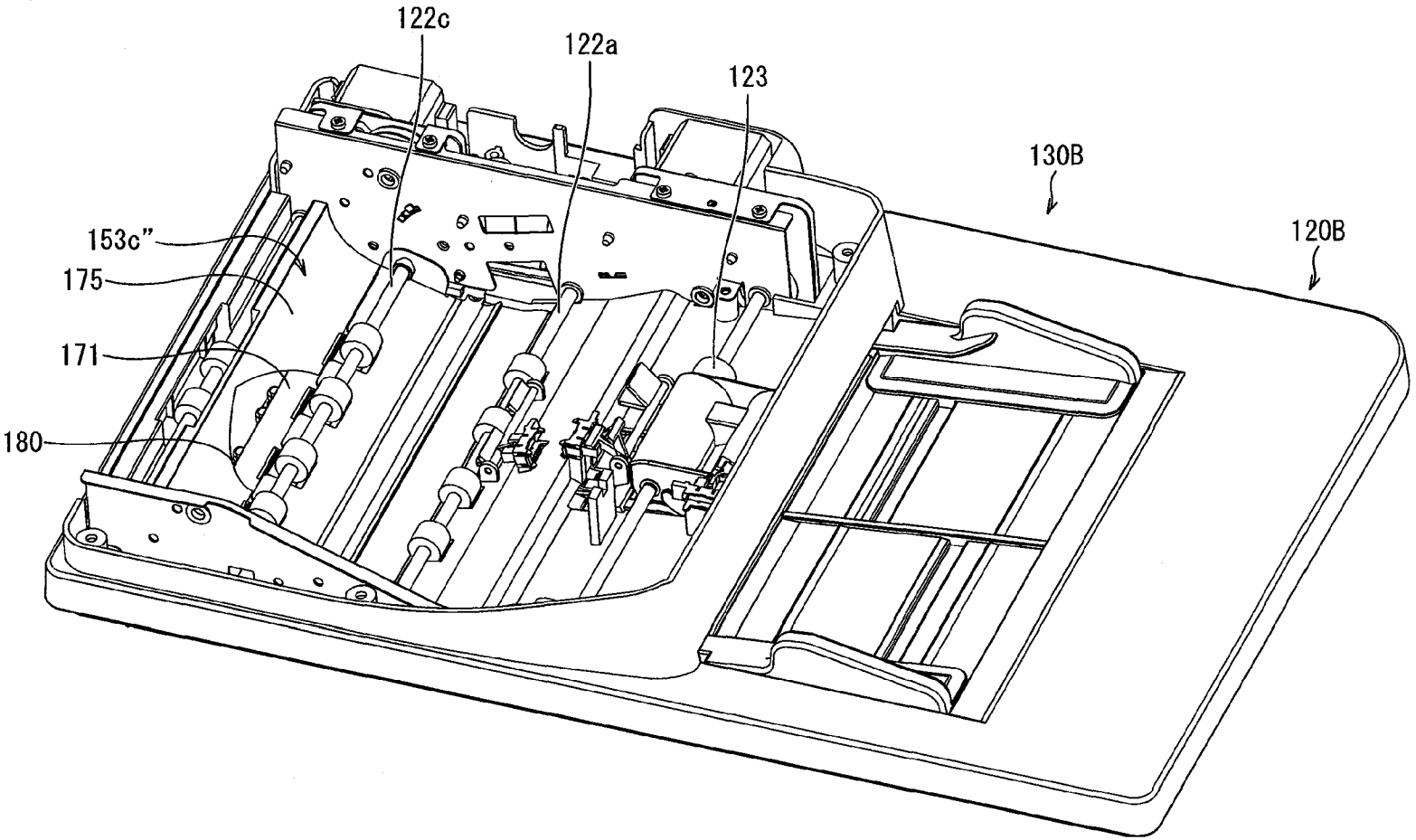
FIG. 15 is a view showing a document reading apparatus including a sheet conveying apparatus, in accordance with still another embodiment of the present invention.

A sheet conveying apparatus of the present embodiment is included in an ADF 120B of a document reading apparatus 130B shown in FIG. 15. The present embodiment can be arranged such that the sheet conveying apparatus of the present embodiment is, in place of the sheet conveying apparatus of First Embodiment, included in a paper feeding conveying mechanism 9 in an apparatus body 110 of an image forming apparatus 100.

The ADF 120B differs from the ADF 120 of First Embodiment in terms of a shape of an opening 180, the opening 180 being formed in a lower conveyance guide 153*c*" constituting a lower half of a U-shaped conveyance guiding section 153.

That is, the ADF 120B is configured such that as shown in FIG. 15, the opening 180 of a triangular shape in place of the opening 170 of the rectangular shape is formed in a central part of a width direction of the lower conveyance guide 153*c*", the opening 180 having a projection plane which is of a triangle when viewed in a direction in which a document is fed into the curved conveyance path.

The opening 180 of the triangular shape has (i) a base of the triangle shape in an upstream of a sheet conveyance direction, and (ii) an apex of the triangle in a downstream of the sheet conveyance direction. The sheet conveying direction is a direction in which a sheet is transported on a curved conveyance path. A guiding surface 175 of the lower conveyance guide 153*c*", other than the opening 180, has a conventional curvature.

Thus, the opening 180 of the triangular shape has a top part gradually tapered. It is therefore possible that a normal document, which is destined to an upper document delivery tray, be transported without being stuck in the opening 180, even in a case where, unlike the opening 170, the top part of the opening 180 is not covered by any member including a wall section 172.

Figure 16:
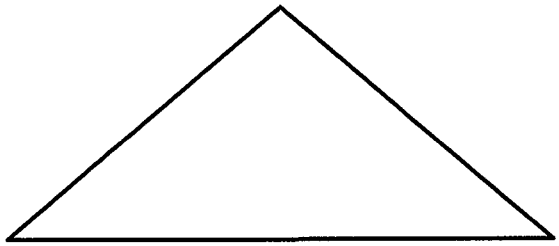
FIGS. 16(*a*) and 16(*b*) are projection views showing, in a sheet conveying direction, an opening formed in the automatic document feeding apparatus of the document reading apparatus.
Figure 16:
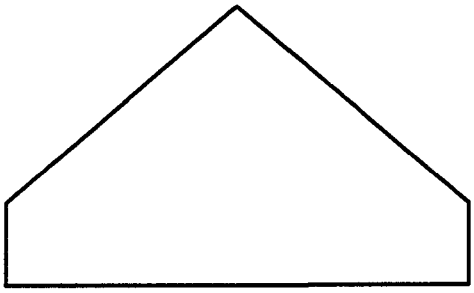

The opening 180 of the triangular shape has a projection plate of a triangular shape as shown in FIG. 16(*a*). However, the present embodiment is not limited to this. Alternatively, it can be configured such that the opening 180 has a projection plane of a home-plate like shape as shown in FIG. 16(*b*), which is composed of a combination of a triangular shape and a rectangular shape connected to a base of the triangular shape.

Therefore, the opening 180 should be such that it has a projection plane including a triangular part, which triangular part is, when viewed in a feeding direction of a document fed into a curved conveyance path, gradually tapered toward a downstream of a conveying direction of a normal document being transported on the curved conveyance path. Thus, the opening 180 can have the projection plane of a triangular shape, whose two lines forming an apex are rounded and/or inclined at different angles.

With the opening 180 having the projection plane of the home-plate like shape shown in FIG. 16(*b*), the projection plane has the rectangular part connected to the bottom end of the triangular shape. With the configuration, even in a case where the opening 180 having the projection plane of the home-plate like shape is identical with the opening 180 having the projection plane of the triangular shape shown in FIG. 16(*a*) in terms of a size in a longitudinal direction, i.e., a guide width direction orthogonal to the document feeding direction, it is less likely to occur that a document being warped and uplifted touches the opening 180. In other words, in the configuration shown in FIG. 16(*a*), it is required that the base of the triangular shape have a larger size than that in the configuration shown in FIG. 16(*b*).

In the above configuration, a small size document, which is to be delivered to a side document-delivery tray 129, is passed through a base part of the triangle shape having a wider area. Thus, the small size document can be freely passed through the opening 180. In a direction extended between a lower end part of the triangular shape of the opening 180 and the side document delivery tray 129, there is provided a flat guide (second sheet conveyance guide) 171 for serving as a straight conveyance guide.

In order to attain the object, a sheet conveying apparatus of the present invention is thus a sheet conveying apparatus, including: a curved conveyance path on which a sheet is transported along a curve of the curved conveyance path; and a first sheet conveyance guide having a curved guiding surface and defining the curved conveyance path, that part of the curved guiding surface of the first sheet conveyance guide, which receives a front end of the sheet fed to the curved conveyance path in a sheet feeding direction, having an opening, the opening having such a size in a guide width direction orthogonal to the sheet feeding direction that allows passage of a small size document not larger than a predetermined size and blocks passage of a large size document larger than the predetermined size.

With the configuration, (i) the small size sheet out of sheets being fed into the curved conveyance path, the small size sheet being not larger than the predetermined size, is transported on the outer side of the curved conveyance path via the opening, and (ii) the large size sheet out of the sheets being fed into the curved conveyance path, the large size sheet being larger than the predetermined size, is transported on an inner side of the curved conveyance path. Thus, it is possible to realize path switching between a conveyance path for the small size sheet and a conveyance path for the large size sheet larger than the small size sheet, without the need for a configuration which (i) provides, at a branch point of the conveyance paths, a switching section including members such as a gate, a solenoid for driving the gate, and the like, and (ii) causes a control section to carry out control of the switching section according to a sheet size. It is therefore possible that with a simple configuration, the sheets be transported on different conveyance paths.

Furthermore, the sheet conveying apparatus of the present invention can be configured so as to include a second sheet conveyance guide which has a flat guiding surface and guides the small size sheet being transported via the opening to another conveyance path other than the curved conveyance path, the small size sheet being transported along the flat guiding surface of the second sheet conveyance guide in a conveying direction parallel to the sheet feeding direction.

For example, if a conveying direction is switched from one to another by a conveyance path being bent in vicinity of the opening on the downstream side, a front end of the small size sheet may be bent. On the other hand, in a case where the small size sheet is a hard sheet, the small size sheet cannot be along the conveyance path being bent as such. Thus, if the front end of the sheet is led upwardly, the entire small size sheet will be uplifted, thereby preventing a central part or a rear end of the sheet from passing through the opening. Thus, there is a risk that sheet jamming is caused.

With the configuration, the small size sheet is straightly passed through the opening, while being kept in the direction in which the small size sheet is fed into the curved conveyance path. Thus, the small size sheet can be freely passed through the opening, and delivered via the curved conveyance path, without being bent at its front end or, in a case where the small size sheet is the hard sheet of the small size, without being uplifted while being passed through the opening.

Furthermore, the sheet conveying apparatus of the present invention can be configured such that: the opening is a rectangular opening, having a projection plane which is of a rectangular shape when viewed in the sheet feeding direction; and a wall section is provided at a downstream end of the rectangular opening, the downstream end of the rectangular opening provided downstream in a conveying direction of the large size sheet being conveyed on the curved conveyance path, the wall section (i) extended toward the another conveyance path on which the small size sheet is transported, and (ii) blocking a downstream side of the rectangular opening, the downstream side of the rectangular opening provided downstream in the conveying direction of the large size sheet being conveyed on the curved conveyance path.

Providing of such wall section causes it that a downstream end of the actual opening for passing therethrough the small size sheet, the downstream end of the actual opening provided downstream in the conveying direction of the large size sheet, is defined by an upstream end of the wall section with respect to the conveying direction of the large size sheet. It is therefore possible that the actual opening be provided on a more outer side of a curve of the curved conveyance path (more downstream side of a direction in which the small size sheet is transported via the opening), as compared to the curved guiding surface of the curved conveyance path.

With this, even when the large size sheet is warped at its front end, and a warped front end of the large size sheet enters the opening, (i) it is prevented that the warped front end of the large size sheet even enters the actual opening, and (ii) the large size sheet is guided by the wall section so as to be freely transported on the curved conveyance path. It is therefore possible to reduce as much as possible occurrence of a failure that the large size sheet being transported on the curved conveyance path is stuck in the opening.

With the configuration including such wall section, it can also be such that the wall section is a flexible member being attached to the downstream end of the rectangular opening, the flexible member having a projection plane which is of a rectangular shape when viewed in the sheet feeding direction, a longitudinal direction of the flexible member having two ends, one of which is a fixed end and the other of which is a free end.

Thus, it is configured such that the downstream side of the rectangular opening is covered by use of the flexible member having the two ends in the longitudinal direction, one of which is the free end and the other one of which is the fixed end. With the configuration, it is possible to differ a size of the transverse direction of the actual opening for the small size sheet from a size of the orthogonal direction of the actual opening for the large size sheet. Thus, even if the small size sheet is warped and touches the flexible member with its front end at a time when the small size sheet is passed through the opening, the flexible member is bent, thereby causing an increase in the size of the transverse direction of the actual opening. As such, the actual opening can pass therethrough the small size sheet without problem.

Thus, by setting the size of the transverse direction of the actual opening to a size which allows, even in a case where the large size sheet to be transported on the curved conveyance path is warped in the rectangular opening, the large size sheet not to be stuck by the lower end of the flexible member, it is possible to freely transport both the large size sheet being warped in the rectangular opening and the small size sheet being bent.

Furthermore, the sheet conveying apparatus of the present invention can be configured such that the opening is a triangular opening, a projection plane of which triangular opening has a triangular part when viewed in the sheet feeding direction, the triangular part being gradually tapered toward a downstream of the conveying direction of the large size sheet.

Thus, the opening is the triangular opening, which has the triangular part being gradually tapered in the conveying direction of the large size sheet being transported on the curved conveyance path. It is therefore possible, without covering any part of the opening by a wall section unlike in the case with the rectangular opening, to cause the large size sheet to be transported without being stuck in the opening.

An automatic document feeding apparatus of the present invention is an automatic document feeding apparatus including the sheet conveying apparatus of the present invention for transporting a document which is a sheet.

An image forming apparatus of the present invention is an image forming apparatus including: an image forming section for carrying out image printing onto a paper; and the sheet conveying apparatus of the present invention for transporting, from the image forming section to a paper delivering section, the paper which is a sheet.

As described above, the sheet conveying apparatus of the present invention makes it possible that with a simple configuration, sheet sorting and transporting can be carried out, based on a size of a sheet. Thus, for example, applying of the sheet conveying apparatus of the present invention in an automatic document feeding apparatus and/or a paper feeding conveying mechanism does not need any increase in cost or any increase in an apparatus size to bring about an effect that a document and/or a recording sheet smaller than a normal recording sheet (a document and/or a recording sheet of a business card size, a member ID card size, or the like) can be easily fed into a different conveyance path so as to be delivered to a different delivery tray.

BRIEF DESCRIPTION OF REFERENCE NUMERALS

91 in-body delivery tray
91, 92 delivery tray
92 side delivery tray
100 image forming apparatus
110 apparatus main unit
120 ADF
120 automatic document feeding apparatus
121 pickup roller
122 conveyance roller
123 paper feeding roller
124, 125 delivery roller pair
126 document placement tray
127 document regulating guide
128 upper document delivery tray
129 side document delivery tray
130 document reading apparatus
130A document reading apparatus
130B document reading apparatus
140 main scanning section
141 housing
142 platen plate
151 reading guide
152 straight conveyance guiding section
153 U-shaped conveyance guiding section (first sheet conveyance guide)
153*a* lower conveyance guide
153*a* upper conveyance guide
153*b* lower conveyance guide
153*c* lower conveyance guide
153*c* first lower conveyance guide
153*c*' lower conveyance guide
153*c*" lower conveyance guide
170 opening
170*a* actual opening
170*b* actual opening
171 flat guide (second sheet conveyance guide)
172 wall section
172A wall section

175 guiding surface
177 flexible member
180 opening

The invention claimed is:

1. A sheet conveying apparatus, comprising:

a curved conveyance path on which a sheet is transported along a curve of the curved conveyance path; and a first sheet conveyance guide having a curved guiding surface and defining the curved conveyance path, that part of the curved guiding surface of the first sheet conveyance guide, which receives a front end of the sheet fed to the curved conveyance path in a sheet feeding direction, having an opening, the opening having such a size in a guide width direction orthogonal to the sheet feeding direction that allows passage of a small size document not larger than a predetermined size and blocks passage of a large size document larger than the predetermined size, wherein:

the opening is a rectangular opening, having a projection plane which is of a rectangular shape when viewed in the sheet feeding direction; and a wall section is provided at a downstream end of the rectangular opening, the downstream end of the rectangular opening provided downstream in a conveying direction of the large size sheet being conveyed on the curved conveyance path, the wall section (i) facing the curved conveyance path, (ii) extended outwardly from the curved conveyance path toward and disposed in another conveyance path other than the curved conveyance path on which the small size sheet is transported, and (iii) blocking a downstream side of the rectangular opening, the downstream side of the rectangular opening provided downstream in the conveying direction of the large size sheet being conveyed on the curved conveyance path.

2. The sheet conveying apparatus as set forth in claim 1, comprising:

a second sheet conveyance guide which has a flat guiding surface and guides the small size sheet being transported via the opening to the another conveyance path other than the curved conveyance path, the small size sheet being transported along the flat guiding surface of the second sheet conveyance guide in a conveying direction parallel to the sheet feeding direction.

3. The sheet conveying apparatus as set forth in claim 1, wherein:

the wall section is a flexible member being attached to the downstream end of the rectangular opening, the flexible member having a projection plane which is of a rectangular shape when viewed in the sheet feeding direction, a longitudinal direction of the flexible member having two ends, one of which is a fixed end and the other of which is a free end.

4. An automatic document feeding apparatus, comprising:

a sheet conveying apparatus for transporting a document which is a sheet, the sheet conveying apparatus including (i) a curved conveyance path on which the sheet is transported along a curve of the curved conveyance path, and (ii) a first sheet conveyance guide, which has a curved guiding surface and constitutes the curved conveyance path, that part of the curved guiding surface of the first sheet conveyance guide, which receives a front end of the sheet fed to the curved conveyance path in a sheet feeding direction, having an opening, the opening having such a size in a guide width direction orthogonal to the sheet feeding direction that allows passage of a small size sheet not larger than a predetermined size and blocks passage of a large size sheet larger than the predetermined size, wherein:

the opening is a rectangular opening, having a projection plane which is of a rectangular shape when viewed in the sheet feeding direction; and a wall section is provided at a downstream end of the rectangular opening, the downstream end of the rectangular opening provided downstream in a conveying direction of the large size sheet being conveyed on the curved conveyance path, the wall section (i) facing the curved conveyance path, (ii) extended outwardly from the curved conveyance path toward and disposed in another conveyance path other than the curved conveyance path on which the small size sheet is transported, and (iii) blocking a downstream side of the rectangular opening, the downstream side of the rectangular opening provided downstream in the conveying direction of the large size sheet being conveyed on the curved conveyance path.

5. An image forming apparatus, comprising:

an image forming section for carrying out image printing onto a paper; and a sheet conveying apparatus for transporting, from the image forming section to a paper delivering section, the paper which is a sheet, the sheet conveying apparatus including (i) a curved conveyance path on which the sheet is transported along a curve of the curved conveyance path, and (ii) a first sheet conveyance guide having a curved guiding surface and constituting the curved conveyance path, that part of the curved guiding surface of the first sheet conveyance guide, which receives a front end of the sheet fed into the curved conveyance path in a sheet feeding direction, having an opening, the opening having such a size in a guide width direction orthogonal to the sheet feeding direction that allows passage of a small size sheet not larger than a predetermined size and blocks passage of a large size sheet larger than the predetermined size, wherein:

the opening is a rectangular opening, having a projection plane which is of a rectangular shape when viewed in the sheet feeding direction; and a wall section is provided at a downstream end of the rectangular opening, the downstream end of the rectangular opening provided downstream in a conveying direction of the large size sheet being conveyed on the curved conveyance path, the wall section (i) facing the curved conveyance path, (ii) extended outwardly from the curved conveyance path toward and disposed in another conveyance path other than the curved conveyance path on which the small size sheet is transported, and (iii) blocking a downstream side of the rectangular opening, the downstream side of the rectangular opening provided downstream in the conveying direction of the large size sheet being conveyed on the curved conveyance path.

* * * * *

UNITED STATES PATENT AND TRADEMARK OFFICE

CERTIFICATE OF CORRECTION

PATENT NO. : 8,561,982 B2
APPLICATION NO. : 12/852546
DATED : October 22, 2013
INVENTOR(S) : Hironori Ogasawara It is certified that error appears in the above-identified patent and that said Letters Patent is hereby corrected as shown below:

In the Claims:

Col. 23, line 16: “document” should read -- sheet --

Col. 23, line 17: “document” should read -- sheet --

Signed and Sealed this
Seventeenth Day of December, 2013

Margaret A. Focarino

Margaret A. Focarino
*Commissioner for Patents of the United States Patent and Trademark Office*